US006311154B1

(12) United States Patent
Gersho et al.

(10) Patent No.: US 6,311,154 B1
(45) Date of Patent: Oct. 30, 2001

(54) ADAPTIVE WINDOWS FOR ANALYSIS-BY-SYNTHESIS CELP-TYPE SPEECH CODING

(75) Inventors: Allen Gersho; Vladimir Cuperman; Ajit V Rao; Tung-Chiang Yang, all of Goleta; Sassan Ahmadi; Fenghua Liu, both of San Diego, all of CA (US)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/223,363

(22) Filed: Dec. 30, 1998

(51) Int. Cl.[7] ..... G10L 19/12
(52) U.S. Cl. ..... 704/219; 704/222; 704/223
(58) Field of Search ..... 704/219, 222, 704/223

(56) References Cited

U.S. PATENT DOCUMENTS

| | | | |
|---|---|---|---|
| 4,184,049 | 1/1980 | Crochiere et al. | 179/1 |
| 4,701,955 | 10/1987 | Taguchi | 381/51 |
| 4,815,135 | 3/1989 | Taguchi | 381/37 |
| 4,969,192 | 11/1990 | Chen et al. | 381/31 |
| 5,166,686 | 11/1992 | Sugiyama | 341/155 |
| 5,293,449 | 3/1994 | Tzeng | 395/2.32 |
| 5,339,384 | 8/1994 | Chen | 395/2.2 |
| 5,394,473 | 2/1995 | Davidson | 381/36 |
| 5,444,816 | 8/1995 | Adoul et al. | 395/2.28 |
| 5,495,555 | 2/1996 | Swaminathan | 395/2.16 |

(List continued on next page.)

FOREIGN PATENT DOCUMENTS

| | | |
|---|---|---|
| 0 573 398 A2 | 12/1993 | (EP) . |
| 0 764 940 A2 | 3/1997 | (EP) . |
| 0 848 374 A2 | 6/1998 | (EP) . |
| 0 854 469 A2 | 7/1998 | (EP) . |

OTHER PUBLICATIONS

PCT International Search Report Feb. 6, 2000 for PCT/IB99/02083.

Investigating the Use of Asymmetric Windows in CELP Vocoders, Florencio, Apr. 27, 1993.

A Variable–Rate Multimodal Speech Coder With Gain–Matched Analysis–By–Synthesis, Paksoy, McCree, and Viswanathan, Apr. 21, 1997.

R. Matmti et al., "How close are we to the network quality 4 kbit/s codec?", in Proceedings of the International Conference on Signal Processing, Application, and Technology (ICSPAT'97), pp. 1684–1687, Sep. 1997.

H. K. Kim, "Adaptive encoding of fixed codebook in CELP coders", in Proceedings of 1998 IEEE International Conference on Acoustic, Speech, and Signal processing (ICASSP'98), pp. 149–152, May 1998.

(List continued on next page.)

*Primary Examiner*—Tālivaldis Ivars Šmits
(74) *Attorney, Agent, or Firm*—Milan I. Patel; Harry Smith

(57) ABSTRACT

A speech coder and a method for speech coding wherein the speech signal is represented by an excitation signal applied to a synthesis filter. The speech is partitioned into frames and subframes. A classifier identifies which of several categories the speech frame belongs to, and a different coding method is applied to represent the excitation for each category. For some categories, one or more windows are identified for the frame where all or most of the excitation signal samples are assigned by a coding scheme. Performance is enhanced by coding the important segments of the excitation more accurately. The window locations are determined from a linear prediction residual by identifying peaks of the smoothed residual energy contour. The method adjusts the frame and subframe boundaries so that each window is located entirely within a modified subframe or frame. This eliminates the artificial restriction incurred when coding a frame or subframe in isolation, without regard for the local behavior of the speech signal across frame or subframe boundaries.

38 Claims, 10 Drawing Sheets

U.S. PATENT DOCUMENTS

| | | | | |
|---|---|---|---|---|
| 5,557,639 | | 9/1996 | Heikkila et al. | 375/224 |
| 5,574,823 | | 11/1996 | Hassanein et al. | 395/2.17 |
| 5,579,433 | | 11/1996 | Jarvinen | 395/228 |
| 5,596,675 | | 1/1997 | Ishii et al. | 395/2.2 |
| 5,596,676 | | 1/1997 | Swaminathan et al. | 395/2.17 |
| 5,596,677 | | 1/1997 | Jarvinen et al. | 395/2.29 |
| 5,651,092 | | 7/1997 | Ishii et al. | 395/2.35 |
| 5,657,418 | | 8/1997 | Gerson et al. | 395/2.16 |
| 5,659,659 | | 8/1997 | Kolesnik et al. | 395/228 |
| 5,701,390 | | 12/1997 | Griffin et al. | 395/2.15 |
| 5,704,003 | | 12/1997 | Kleijn et al. | 395/2.29 |
| 5,749,065 | | 5/1998 | Nishiguchi et al. | 704/219 |
| 5,751,903 | | 5/1998 | Swaminathan et al. | 395/2.39 |
| 5,752,223 | * | 5/1998 | Aoyagi et al. | 704/219 |
| 5,754,974 | | 5/1998 | Griffin et al. | 704/206 |
| 5,765,126 | | 6/1998 | Tsutsui et al. | 704/206 |
| 5,774,837 | | 6/1998 | Yeldener et al. | 704/208 |
| 5,787,389 | | 7/1998 | Taumi et al. | 704/219 |
| 5,796,757 | | 8/1998 | Czaja | 371/46 |
| 5,854,978 | | 12/1998 | Heidari | 455/418 |

OTHER PUBLICATIONS

Tzeng, F.F., "An Analysis–By–Synthesis Linear Predictive Model For Narrowband Speech Coding", IEEE, ICASSP 1990, S4a. 11, pp. 209–212.

"Enhanced Variable Rate Codec, Speech Service Option 3 for Wideband Spread Spectrum Digital Systems", TIA/EIA/IS–127, Telecommunications Industry Association 1997, 72 pgs.

Akamine, Masami et al., "CELP Coding With An Adaptive Density Pulse Excitation Model", IEEE, ICASSP 1990, S1.8, pp. 29–32.

Wang, Shihua et al., "Phonetically–Based Vector Excitation Coding of Speech at 3.6 kbps", IEEE ICASSP vol. 1, May 23, 1989, 5 pages.

Jayant, Nikil et al., "Signal Compression Based on Models of Human Perception", IEEE, vol. 81, No. 10, 10/93, pp. 1385–1422.

* cited by examiner

ADAPTIVE WINDOWS FOR ANALYSIS-BY-SYNTHESIS CELP-TYPE SPEECH CODING

FIELD OF THE INVENTION

This invention relates generally to digital communications and, in particular, to speech or voice coder (vocoder) and decoder methods and apparatus.

BACKGROUND OF THE INVENTION

One type of voice communications system of interest to the teaching of this invention uses a code division, multiple access (CDMA) technique such as one originally defined by the EIA Interim Standard IS-95A, and in later revisions thereof and enhancements thereto. This CDMA system is based on a digital spread-spectrum technology which transmits multiple, independent user signals across a single 1.25 MHz segment of radio spectrum. In CDMA, each user signal includes a different orthogonal code and a pseudo-random binary sequence that modulates a carrier, spreading the spectrum of the waveform, and thus allowing a large number of user signals to share the same frequency spectrum. The user signals are separated in the receiver with a correlator which allows only the signal energy from the selected orthogonal code to be de-spread. The other users signals, whose codes do not match, are not de-spread and, as such, contribute only to noise and thus represent a self-interference generated by the system. The SNR of the system is determined by the ratio of desired signal power to the sum of the power of all interfering signals, enhanced by the system processing gain or the spread bandwidth to the baseband data rate.

The CDMA system as defined in IS-95A uses a variable rate voice coding algorithm in which the data rate can change dynamically on a 20 millisecond frame by frame basis as a function of the speech pattern (voice activity). The Traffic Channel frames can be transmitted at full, ½, ¼ or ⅛ rate (9600, 4800, 2400 and 1200 bps, respectively). With each lower data rate, the transmitted power ($E_s$) is lowered proportionally, thus enabling an increase in the number of user signals in the channel.

Toll quality speech reproduction at low bit rates (e.g., around 4,000 bits per second (4 kb/s) and lower, such as 4, 2 and 0.8 kb/s) has proven to be a difficult task. Despite efforts made by many speech researchers, the quality of speech that is coded at low bit rates is typically not adequate for wireless and network applications. In the conventional CELP algorithm, the excitation is not efficiently generated and the periodicity existing in the residual signal during voiced intervals is not appropriately exploited. Moreover, CELP coders and their derivatives have not shown satisfactory subjective performance at low bit rates.

In a conventional analysis-by-synthesis ("AbS") coding of speech, the speech waveform is partitioned into a sequence of successive frames. Each frame has a fixed length and is partitioned into an integer number of equal length subframes. The encoder generates an excitation signal by a trial and error search process whereby each candidate excitation for a subframe is applied to a synthesis filter, and the resulting segment of synthesized speech is compared with a corresponding segment of target speech. A measure of distortion is computed and a search mechanism identifies the best (or nearly best) choice of excitation for each subframe among an allowed set of candidates. Since the candidates are sometimes stored as vectors in a codebook, the coding method is referred to as code excited linear prediction (CELP). At other times, the candidates are generated as they are needed for the search by a predetermined generating mechanism. This case includes, in particular, multi-pulse linear predictive coding (MP-LPC) or algebraic code excited linear prediction (ACELP). The bits needed to specify the chosen excitation subframe are part of the package of data that is transmitted to the receiver in each frame.

Usually the excitation is formed in two stages, where a first approximation to the excitation subframe is selected from an adaptive codebook which contains past excitation vectors, and then a modified target signal is formed as the new target for a second AbS search operation which uses the above described procedure.

In Relaxation CELP (RCELP) in the Enhanced Variable Rate Coder (TIA/EIA/IS-127) the input speech signal is modified through a process of time warping to ensure that it conforms to a simplified (linear) pitch contour. The modification is performed as follows.

The speech signal is divided into frames and linear prediction is performed to generate a residual signal. A pitch analysis of the residual signal is then performed, and an integer pitch value, computed once per frame, is transmitted to the decoder. The transmitted pitch value is interpolated to obtain a sample-by-sample estimate of the pitch, defined as the pitch contour. Next, the residual signal is modified at the encoder to generate a modified residual signal, which is perceptually similar to the original residual. In addition, the modified residual signal exhibits a strong correlation between samples separated by one pitch period (as defined by the pitch contour). The modified residual signal is filtered through a synthesis filter derived from the linear prediction coefficients, to obtain the modified speech signal. The modification of the residual signal may be accomplished in a manner described in U.S. Pat. No. 5,704,003.

The standard encoding (search) procedure for RCELP is similar to regular CELP except for two important differences. First, the RCELP adaptive excitation is obtained by time-warping the past encoded excitation signal using the pitch contour. Second, the analysis-by-synthesis objective in RCELP is to obtain the best possible match between the synthetic speech and the modified speech signal.

OBJECTS AND ADVANTAGES OF THE INVENTION

It is a first object and advantage of this invention to provide a method and circuitry that implements a vocoder of the analysis-by-synthesis (AbS) type having adaptively modified subframe boundaries and adaptively determined window sizes and locations within subframes.

It is a second object and advantage of this invention to provide a time-domain real-time speech coding/decoding system based at least in part on a code excited linear prediction (CELP) type algorithm, the speech coding/decoding system using adaptive windows.

It is a further object and advantage of this invention to provide an algorithm and a corresponding apparatus that overcome many of the foregoing problems by employing a novel excitation encoding scheme with a CELP or Relaxation CELP (RCELP) model wherein a pattern classifier is used to determine a classification that best describes the character of the speech signal in each frame, and to then encode the fixed excitation using class-specific structured codebooks.

It is another object and advantage of this invention to provide a method and circuitry that implements a speech coder of the analysis-by-synthesis (AbS) type, wherein the use of adaptive windows enables a relatively limited number of bits to be more efficiently allocated to describe the excitation signal, which results in enhanced speech quality compared to the conventional use of CELP-type coders at bit rates as low as 4 kbps or lower.

SUMMARY OF THE INVENTION

The foregoing and other problems are overcome and the objects and advantages of the invention are realized by methods and apparatus that provide an improved time domain, CELP-type voice coder/decoder.

A presently preferred speech coding model uses a novel class-dependent approach for generating and encoding the fixed codebook excitation. The model preserves the RCELP approach to generate and encode efficiently the adaptive codebook contribution for voiced frames. However, the model introduces different excitation encoding strategies for each of a plurality of residual signal classes, such as voiced, transition, and unvoiced, or for strongly periodic, weakly periodic, erratic (transition), and unvoiced. The model employs a classifier that provides for a closed-loop transition/voiced selection. The fixed-codebook excitation for voiced frames is based on an enhanced adaptive window approach, which is shown to be effective in achieving high quality speech at a rate of, by example, 4 kb/s and below.

In accordance with one aspect of this invention the excitation signal within a subframe is constrained to be zero outside of selected intervals within the subframe. These intervals are referred to herein as windows.

In accordance with a further aspect of this invention there is disclosed a technique for determining the location and size of the windows, and identifying those critical segments of the excitation signal which are particularly important to represent with a suitable selection of pulse amplitudes. The subframe and frame sizes are allowed to vary (in a controlled manner) to suit the local characteristics of the speech signal. This provides for an efficient coding of the windows without having a window cross a boundary between two adjacent subframes. In general, the size of the windows and their locations are adapted according to the local characteristics of the input or target speech signal. As employed herein, locating a window refers to positioning a window around energy peaks associated with the residual signal, depending on the short-term energy profile.

In accordance with a further aspect of this invention a highly efficient encoding of the excitation frame is achieved by directing processing to the windows themselves, and allocating all or nearly all of the available bits to code the regions inside the windows.

Further in accordance with the teachings of this invention, a reduced complexity method for coding the signal inside a window is based on the use of ternary valued amplitudes, 0, −1, and +1. The reduced complexity coding method is also based on exploiting a correlation between successive windows in periodic speech segments.

A toll quality speech coding technique in accordance with this invention is a time-domain scheme which exploits novel ways to represent and encode speech signals at different data rates, depending on the nature and the amount of information contained in short-time segments of the speech signal.

This invention is directed to various embodiments of methods and apparatus for coding an input speech signal. The speech signal may be derived directly from an output of a speech transducer, such as a microphone, that is used to make a voice telephone call. Alternatively, the input speech signal may be received as a digital data stream over a communications cable or network, having been first sampled and converted from analog to digital data at some remote location. As but one example, in a fixed site or base station for a wireless radiotelephone system, an input speech signal at the base station may typically arrive from a landline telephone cable.

In any case, the method has steps of (a) partitioning speech signal samples into frames; (b) determining the location of at least one window in the frame; and (c) encoding an excitation for the frame whereby all or substantially all of non-zero excitation amplitudes lie within the at least one window. In a presently preferred embodiment the method further includes a step of deriving a residual signal for each frame, and the location of the at least one window is determined by examining the derived residual signal. In a more preferred embodiment the step of deriving includes a step of smoothing an energy contour of the residual signal, and the location of the at least one window is determined by examining the smoothed energy contour of the residual signal. The at least one window can be located so as to have an edge that coincides with at least one of a subframe boundary or a frame boundary.

Further in accordance with this invention there is provided a method for coding a speech signal that includes steps of (a) partitioning samples of a speech signal into frames; (b) deriving a residual signal for each frame; (c) classifying the speech signal in each frame into one of a plurality of classes; (d) identifying the location of at least one window in the frame by examining the residual signal for the frame; (e) encoding an excitation for the frame using one of a plurality of excitation coding techniques selected according to the class of the frame; and, for at least one of the classes, (f) confining all or substantially all of non-zero excitation amplitudes to lie within the windows.

In one embodiment the classes include voiced frames, unvoiced frames, and transition frames, while in another embodiment the classes include strongly periodic frames, weakly periodic frames, erratic frames, and unvoiced frames.

In a preferred embodiment the step of classifying the speech signal includes a step of forming a smoothed energy contour from the residual signal, and a step of considering a location of peaks in the smoothed energy contour.

One of the plurality of codebooks may be an adaptive codebook, and/or one of the plurality of codebooks may be a fixed ternary pulse coding codebook.

In the preferred embodiment of this invention the step of classifying uses an open loop classifier followed by a closed loop classifier.

Also in a preferred embodiment of this invention, the step of classifying uses a first classifier to classify a frame as being one of an unvoiced frame or a not unvoiced frame, and a second classifier for classifying a not unvoiced frame as being one of a voiced frame or a transition frame.

In the method the step of encoding includes steps of partitioning the frame into a plurality of subframes; and positioning at least one window within each subframe, wherein the step of positioning at least one window positions a first window at a location that is a function of a pitch of the frame, and positions subsequent windows as a function of the pitch of the frame and as a function of the position of the first window.

The step of identifying the location of at least one window preferably includes the step of smoothing the residual signal, and the step of identifying considers the presence of energy peaks in the smoothed contour of the residual signal.

In the practice of this invention a subframe or frame boundary can be modified so that the window lies entirely within the modified subframe or frame, and the subframe or frame boundary is located so as to have an edge of the modified frame or subframe coincide with a window boundary.

To summarize, this invention is directed to a speech coder and a method for speech coding wherein the speech signal is represented by an excitation signal applied to a synthesis filter. The speech signal is partitioned into frames and subframes. A classifier identifies which of several categories a speech frame belongs to, and a different coding method is applied to represent the excitation for each category. For some categories, one or more windows are identified for the frame where all or most of the excitation signal samples are assigned by a coding scheme. Performance is enhanced by coding the important segments of the excitation more accurately. The window locations are determined from a linear prediction residual by identifying peaks of the smoothed residual energy contour. The method adjusts the frame and subframe boundaries so that each window is located entirely within a modified subframe or frame. This eliminates the artificial restriction incurred when coding a frame or subframe in isolation, without regard for the local behavior of the speech signal across frame or subframe boundaries.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
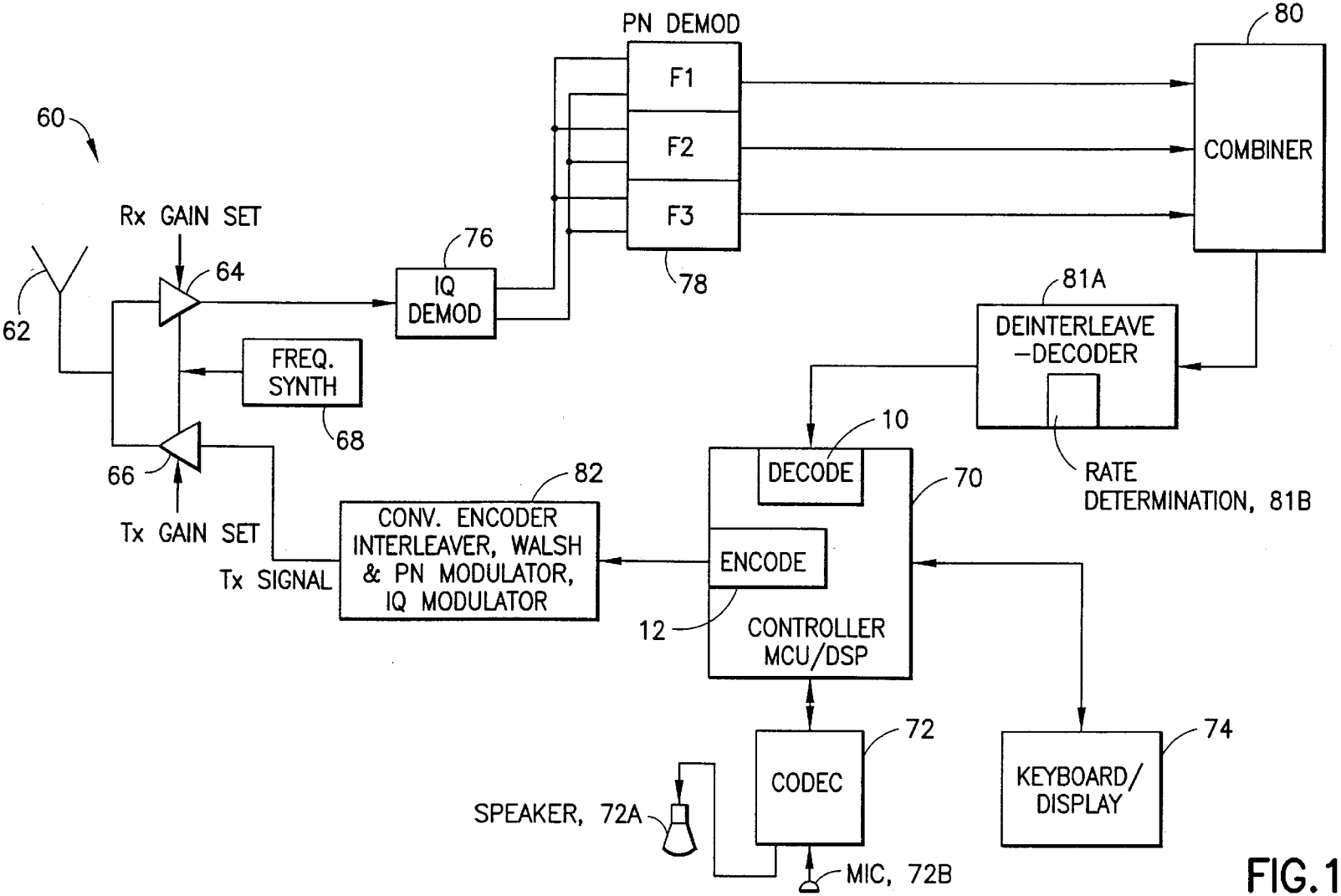
FIG. 1 is block diagram of one embodiment of a radiotelephone having circuitry suitable for practicing this invention.

Referring to FIG. 1, there is illustrated a spread spectrum radiotelephone 60 that operates in accordance with the voice coding methods and apparatus of this invention. Reference can also be had to commonly assigned U.S. Pat. No. 5,796,757, issued Aug. 18, 1998, for a description of a variable rate radiotelephone within which this invention could be practiced. The disclosure of U.S. Pat. No. 5,796,757 is incorporated herein in its entirety.

It should be realized at the outset that certain ones of the blocks of the radiotelephone 60 may be implemented with discrete circuit elements, or as software routines that are executed by a suitable digital data processor, such as a high speed signal processor. Alternatively, a combination of circuit elements and software routines can be employed. As such, the ensuing description is not intended to limit the application of this invention to any one particular technical embodiment.

The spread spectrum radiotelephone 60 may operate in accordance with the TIA/EIA Interim Standard, Mobile Station-Base Station Compatibility Standard for Dual-Mode Wideband Spread Spectrum Cellular System, TIA/EIA/IS-95 (July 1993), and/or in accordance with later enhancements and revisions of this standard. However, compatibility with any particular standard or air interface specification is not to be considered as a limitation upon the practice of this invention.

It should also be noted at the outset that the teachings of this invention are not limited to use with a Code Division Multiple Access (CDMA) technique or a spread spectrum technique, but could be practiced as well in, by example, a Time Division Multiple Access (TDMA) technique, or some other multiple user access technique (or in a single user access technique as well).

The radiotelephone 60 includes an antenna 62 for receiving RF signals from a cell site, which may be referred to as a base station (not shown), and for transmitting RF signals to the base station. When operating in the digital (spread spectrum or CDMA) mode the RF signals are phase modulated to convey speech and signalling information. Coupled to the antenna 62 are a gain controlled receiver 64 and a gain controlled transmitter 66 for receiving and for transmitting, respectively, the phase modulated RF signals. A frequency synthesizer 68 provides the required frequencies to the receiver and transmitter under the direction of a controller 70. The controller 70 is comprised of a slower speed microprocessor control unit (MCU) for interfacing, via a codec 72, to a speaker 72A and a microphone 72B, and also to a keyboard and a display 74. The microphone 72B may be generally considered as an input speech transducer whose output is sampled and digitized, and which forms the input to the speech encoder in accordance with one embodiment of this invention.

In general, the MCU is responsible for the overall control and operation of the radiotelephone 60. The controller 70 is also preferably comprised of a higher speed digital signal processor (DSP) suitable for real-time processing of received and transmitted signals, and includes a speech decoder 10 (see FIG. 14) for decoding speech in accordance with this invention, and a speech encoder 12 for encoding speech in accordance with this invention, which may be referred to together as a speech processor.

The received RF signals are converted to baseband in the receiver and are applied to a phase demodulator 76 which derives in-phase (I) and quadrature (Q) signals from the received signal. The I and Q signals are converted to digital representations by suitable A/D converters and applied to a multiple finger (e.g., three fingers F1–F3) demodulator 78, each of which includes a pseudonoise (PN) generator. The output of the demodulator 78 is applied to a combiner 80 which outputs a signal, via a deinterleaver and decoder 81A and rate determination unit 81B, to the controller 70. The digital signal input to the controller 70 is expressive of the received encoded speech samples or signalling information.

An input to the transmitter 66, which is coded speech in accordance with this invention and/or signalling information, is derived from the controller 70 via a convolutional encoder, interleaver, Walsh modulator, PN modulator, and I-Q modulator, which are shown collectively as the block 82.

Having described one suitable embodiment of a speech communications device that can be constructed so as to encode and decode speech in accordance with this invention, a detailed description of presently preferred embodiments of the speech coder and corresponding decoder will now be provided with reference to FIGS. 2–13.

Figure 2:
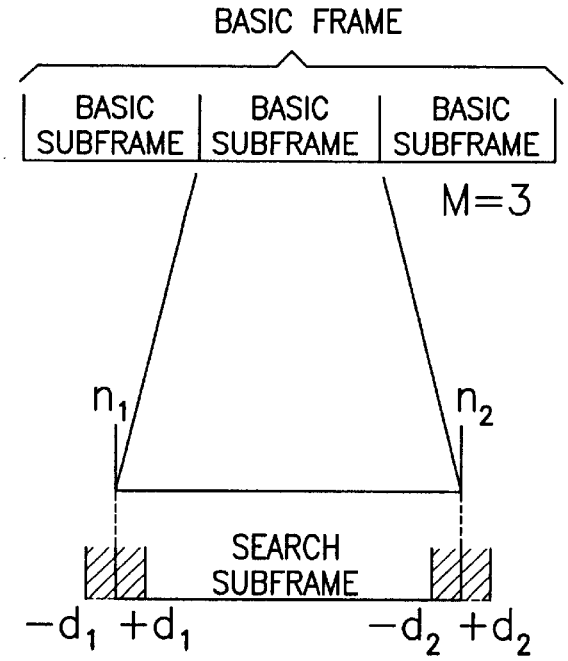
FIG. 2 is a diagram illustrating a basic frame partitioned into a plurality (3) of basic subframes, and also shows a search subframe.

Referring to FIG. 2, for the purpose of performing LP analysis on the input speech, and for the purpose of packaging the data to be transmitted into a fixed number of bits for each fixed frame interval, the speech encoder 12 has a fixed frame structure which is referred to herein as a basic frame structure. Each basic frame is partitioned into M equal (or nearly equal) length subframes which are referred to herein as basic subframes. One suitable, but not limiting, value for M is three.

In conventional AbS coding schemes, the excitation signal for each subframe is selected by a search operation. However, to achieve a highly efficient, low bit rate coding of speech, the low number of bits available to code each subframe makes it very difficult or impossible to obtain an adequately precise representation of the excitation segment.

The inventors have observed that the significant activity in an excitation signal is not uniformly distributed over time. Instead, there are certain naturally-occurring intervals of the excitation signal which contain most of the important activity, referred to herein as active intervals, and outside of the active intervals little or nothing is lost by setting the excitation samples to zero. The inventors have also discovered a technique to identify the location of the active intervals by examining a smoothed energy contour of the linear prediction residual. Thus, the inventors have determined that one may find the actual time location of the active intervals, referred to herein as windows, and that one may then concentrate the coding effort to be within the windows that correspond to the active intervals. In this way the limited bit rate available for coding the excitation signal can be dedicated to efficiently representing the important time segments or subintervals of the excitation.

It should be noted that while in some embodiments it may be desirable to have all of the non-zero excitation amplitudes located within the windows, in other embodiments it may be desirable, for enhanced flexibility, to allow at least one or a few non-zero excitation amplitudes to be outside of the windows.

The subintervals need not be synchronous with the frame or subframe rates, and thus it is desirable to adapt the location (and duration) of each window to suit the local characteristics of the speech. To avoid introducing a large overhead of bits for specifying the window location, the inventors instead exploit a correlation that exists in successive window locations, and thus limit the range of allowable window locations. It has been found that one suitable technique to avoid expending bits for specifying the window duration is by making the window duration dependent on the pitch for voiced speech, and by keeping the window duration fixed for unvoiced speech. These aspects of the invention are described in further detail below.

Since each window is an important entity to be coded, it is desirable that each basic subframe contain an integer number of windows. If this were not the case then a window might be split between two subframes, and the correlation that exists within a window would not be exploited.

Therefore, for the AbS search process, it is desirable to adaptively modify the subframe size (duration) to assure that an integer number of windows will be present in the excitation segment to be coded.

Corresponding to each basic subframe there is associated a search subframe, which is a contiguous set of time instants having starting and ending points offset from those of the basic frame. Thus, and still referring to FIG. 2, if a basic subframe extends from time $n_1$ to $n_2$, the associated search subframe extends from $n_1+d_1$ to $n_2+d_2$, where $d_1$ and $d_2$ have values of either zero or some small positive or negative integers. The magnitudes of $d_1$ and $d_2$ defined so as to be always less than half the window size, and their values are chosen so that each search subframe will contain an integer number of windows.

If a window crosses a basic subframe boundary, then the subframe is either shortened or extended so that the window is entirely contained in either the next or the current basic subframe. If the center of the window lies inside a current basic subframe, then the subframe is extended so that the subframe boundary coincides with the endpoint of the window. If the center of the window lies beyond the current basic subframe, then the window is shortened so that the subframe boundary coincides with the starting point of the window. The starting point of the next search subframe is accordingly modified to be immediately after the endpoint of the prior search subframe.

For each basic frame, the method in accordance with this invention generates M contiguous search subframes, which together constitute what is referred to herein as a search frame. The endpoint of the search frame is modified from that of the basic frame so that it coincides with the endpoint of the last search subframe associated with the corresponding basic frame. The bits that are used to specify the excitation signal for the entire search frame are ultimately packaged into a data packet for each basic frame. The transmission of data to the receiver is therefore consistent with the conventional fixed frame structure of most speech coding systems.

The inventors have found that the introduction of adaptive windows and adaptive search subframes greatly improves the efficiency of AbS speech coding. Further details are now presented so as to aid in an understanding of the speech coding method and apparatus of this invention.

Figure 3:
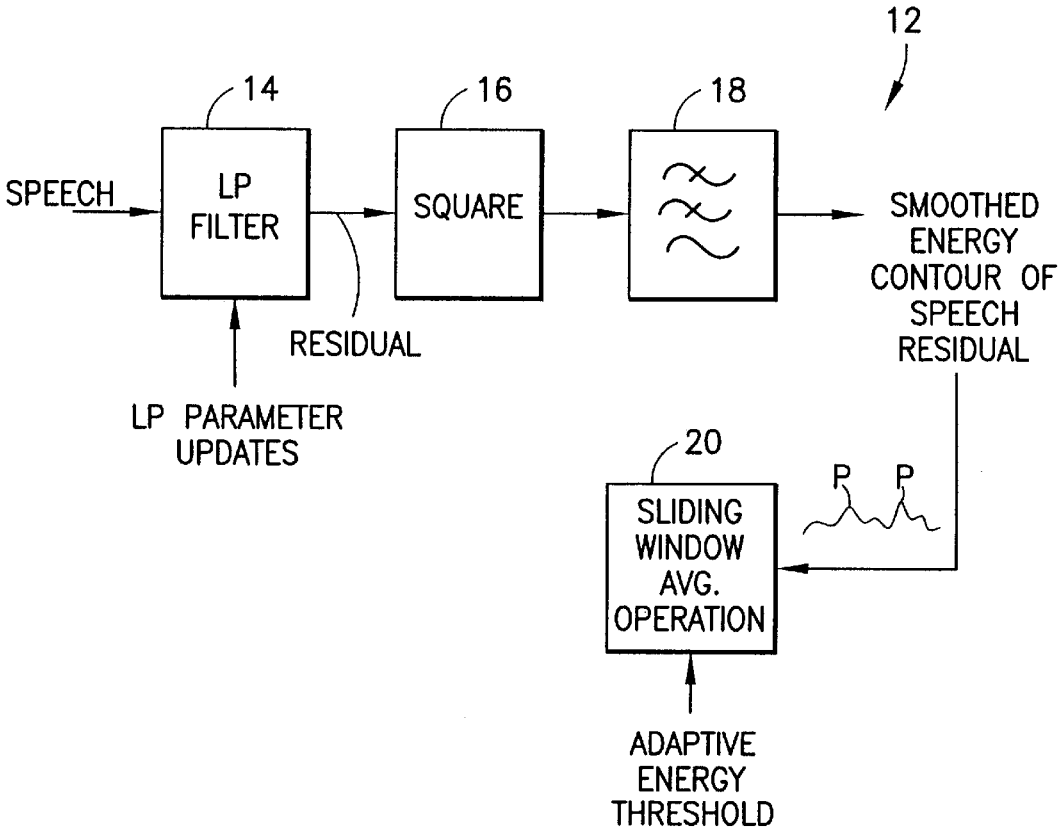
FIG. 3 is a simplified block diagram of circuitry for obtaining a smooth energy contour of a speech residual signal.

A discussion of a technique for locating windows will first be given. A smoothed energy contour of the speech residual signal is obtained and processed to identify energy peaks. Referring to FIG. 3, the residual signal is formed by filtering speech through a linear prediction (LP) whitening filter 14 wherein the linear prediction parameters are regularly updated to track changes in the speech statistics. The residual signal energy function is formed by taking a non-negative function of the residual sample values, such as the square or the absolute value. For example, the residual signal energy function is formed in squaring block 16. The technique then smooths the signal by a linear or nonlinear smoothing operation, such as a low pass filtering operation or a median smoothing operation. For example, the residual signal energy function formed in the squaring block 16 is subjected to a low pass filtering operation in low pass filter 18 to obtain the smoothed energy contour.

A presently preferred technique uses a three point sliding window averaging operation that is carried out in block 20. The energy peaks (P) of the smooth residual contour are located using an adaptive energy threshold. A reasonable choice for locating a given window is to center it at the peak of the smoothed energy contour. This location then defines an interval wherein it is most important to model the excitation with non-zero pulse amplitudes, i.e., defines the center of the above-mentioned active interval.

Having described a preferred technique for locating windows, a discussion will now be given of a technique for classifying frames, as well as a class dependent technique for finding the excitation signal in the windows.

The number of bits needed to code the excitation within an individual window is substantial. Since multiple windows may occur in a given search subframe, an excessive number of bits for each search subframe would be needed if each window were coded independently. Fortunately, the inventors have determined that there is a considerable correlation between different windows in the same subframe for periodic speech segments. Depending on the periodic or aperiodic character of the speech, different coding strategies can be employed. In order to exploit as much redundancy as possible in coding the excitation signal for each search subframe, it is therefore desirable to classify the basic frames into categories. The coding method can then be tailored and or selected for each category.

In voiced speech, the peaks of the smoothed residual energy contour generally occur at pitch period intervals and correspond to pitch pulses. In this context "pitch" refers to the fundamental frequency of periodicity in a segment of voiced speech, and "pitch period" refers to the fundamental period of periodicity. In some transitional regions of the speech signal, which are referred to herein also as erratic regions, the waveform does not have the character of being either periodic or stationary random, and often it contains one or more isolated energy bursts (as in plosive sounds). For periodic speech, the duration, or width, of a window may be chosen to be some function of the pitch period. For example, the window duration may be made a fixed fraction of the pitch period.

In one embodiment of this invention, described next, a four way classification for each basic frame provides a satisfactory solution. In this first embodiment the basic frame is classified as being one of a strongly periodic, weakly periodic, erratic, or an unvoiced frame. However, and as will be described below in reference to another embodiment, a three way classification can be used, wherein a basic frame is classified as being one of a voiced, a transition, or an unvoiced frame. It is also within the scope of this invention to use two classifications (e.g., voiced and unvoiced), as well as more than four classifications.

In a presently preferred embodiment the sampling rate is 8000 samples per second (8 ks/s), the basic frame size is 160 samples, the number of subframes is M=3, and the three basic subframe sizes are 53 samples, 53 samples, and 54 samples. Each basic frame is classified into one of the foregoing four classes: strongly periodic, weakly periodic, erratic, and unvoiced.

Figure 4:
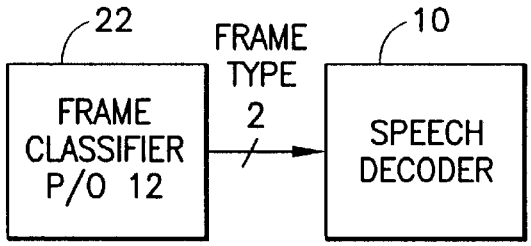
FIG. 4 is a simplified block diagram showing a frame classifier outputting a frame type indication to a speech decoder.

Referring to FIG. 4, a frame classifier 22 sends two bits per basic frame to the speech decoder 10 (see FIG. 14) in the receiver to identify the class (00, 01, 10, 11). Each of the four basic frame classes is described below, along with their respective coding schemes. However, and as was mentioned above, it should be noted that an alternative classification scheme with a different number of categories may be even more effective in some situations and applications, and further optimization of the coding strategies is quite possible. As such, the following description of presently preferred frame classifications and coding strategies should not be read in a limiting sense upon the practice of this invention.

Strongly Periodic Frames

This first class contains basic frames of speech that are highly periodic in character. The first window in the search frame is associated with a pitch pulse. Thus one can reasonably assume that successive windows are located approximately at successive pitch period intervals.

The location of the first window in each basic frame of voiced speech is transmitted to the decoder 10. Subsequent windows within the search frame are positioned at successive pitch period intervals from the first window. If the pitch period varies within a basic frame, the computed or interpolated pitch value for each basic subframe is used to locate successive windows in the corresponding search subframe. A window size of 16 samples is used when the pitch period is below 32 samples, and a window size of 24 samples is used when the pitch period is equal to or greater than 32 samples. The starting point of the window in the first frame of a sequence of consecutive periodic frames is specified using, for example, four bits. Subsequent windows within the same search frame start at one pitch period following the start of the prior window. The first window in each subsequent voiced search frame is located in a neighborhood of the starting point predicted by adding one pitch period to the prior window starting point. Then the search process determines the exact starting point. Two bits, by example, are used to specify a deviation of the starting point from the predicted value. This deviation may also be referred to as "jitter".

It is pointed out that the specific number of bits used for the various representations is application specific, and may vary widely. For example, the teachings of this invention are certainly not limited to the presently preferred use of four bits for specifying the starting point of the window in the first frame, or two bits for specifying the deviation of the starting point from the predicted value.

Figure 5:
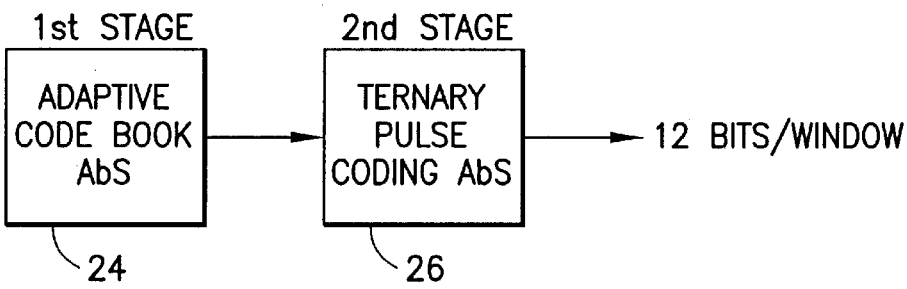
FIG. 5 depicts a two stage encoder having an adaptive codebook first stage and a ternary pulse coder second stage.
Figure 6:
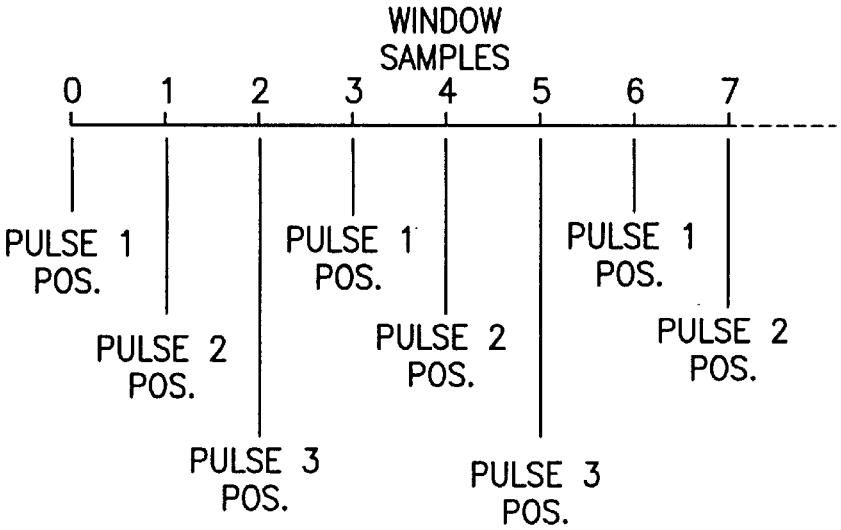
FIG. 6 is an exemplary window sampling diagram.

Referring to FIG. 5, a two-stage AbS coding technique is used for each search subframe. The first stage 26 is based on the "adaptive codebook" technique where a segment of the past of the excitation signal is selected as the first approximation to the excitation signal in the subframe. The second stage 26 is based on a ternary pulse coding method. Referring to FIG. 6, for windows of size 24 samples the ternary pulse coder 26 identifies three non-zero pulses, one selected from the sample positions 0, 3, 6, 9, 12, 15, 18, 21; the second pulse position is selected from 1, 4, 7, 10, 13, 16, 19, 22, and the third pulse from 2, 5, 8, 11, 14, 17, 20, 23. Thus three bits are needed to specify each of the three pulse positions, and one bit is needed for the polarity of each pulse. Hence a total of 12 bits are used to code the window. A similar method is used for windows of size 16. Repeating the same pulse pattern as in the first window of the search subframe represents subsequent windows in the same search subframe. Therefore no additional bits are needed for these subsequent windows.

Weakly Periodic Frames

This second class contains basic frames of speech that exhibit some degree of periodicity, but that lack the strong regular periodic character of the first class. Thus one cannot assume that successive windows are located at successive pitch period intervals.

The location of each window in each basic frame of voiced speech is determined by the energy contour peaks and is transmitted to the decoder. An improved performance can be obtained if the location is found by performing the AbS search process for each candidate location, but this technique results in higher complexity. A fixed window size of 24 samples is used with only one window per search subframe. Three bits are used to specify the starting point of each window using a quantized time grid, i.e., the start of a window is allowed to occur at multiples of 8 samples. In effect, the window location is "quantized", thereby reducing the time resolution with a corresponding reduction in the bit rate.

As with the first classification, the two-stage analysis-by-synthesis coding technique is used. Referring again to FIG. 5, the first stage 24 is based on the adaptive codebook method and the second stage 26 is based on the ternary pulse coding method.

Erratic Frames

This third class contains basic frames where the speech is neither periodic nor random, and where the residual signal contains one or more distinct energy peaks. The excitation signal for erratic speech frames is represented by identifying one excitation within the window per subframe corresponding to the location of a peak of the smoothed energy contour. In this case, the location of each window is transmitted.

The location of each window in each basic frame of voiced speech is determined by the energy contour peaks and is transmitted to the decoder 10. As with the weakly periodic case, an improved performance can be obtained if the location is found by performing the AbS search process for each candidate location, but at the cost of higher complexity. It is preferred to use a fixed window size of 32 samples and only one window per search subframe. Also as with the weakly periodic case, three bits are employed to specify the starting point of each window using a quantized time grid, i.e, the start of a window is allowed to occur at multiples of eight samples thereby reducing the time resolution in order to reduce the bit rate.

A single AbS coding stage is used, as the adaptive codebook is not generally useful for this class.

Unvoiced Frames

This fourth class contains basic frames which are not periodic, and where the speech appears random-like in character, without strong isolated energy peaks. The excitation is coded in a conventional manner using a sparse random codebook of excitation vectors for each basic subframe.

Due to the random character of the needed excitation signal, windowing is not required. The search frames and subframes always coincide with the basic frames and subframes, respectively. A single AbS coding stage can be used with a fixed codebook containing randomly located ternary pulses.

As was noted previously, the foregoing description should not be construed so as to limit the teaching and practice of this invention. For example, and as was described above, for each window the pulse position and polarity are coded with ternary pulse coding so that 12 bits are required for three pulses and a window of size 24. An alternative embodiment, referred to as a vector quantization of window pulses, employs a pre-designed codebook of pulse patterns so that each codebook entry represents a particular window pulse sequence. In this way it is possible to have windows containing more than three non-zero pulses, while requiring relatively few bits. For example, if 8 bits are allowed for coding the window, then a codebook with 256 entries would be required. The codebook preferably represents the window patterns that are statistically the most useful representatives out of the very large number of all possible pulse combinations. The same technique can of course be applied to windows of other sizes. More specifically, the choice of the most useful pulse patterns is done by computing a perceptually weighted cost function; i.e., a distortion measure associated with each pattern, and choosing the patterns with the highest cost or correspondingly the lowest distortion.

In the strongly periodic class, or in a periodic class for a three class system (described below), it was described above that the first window in each voiced search frame is located in a neighborhood of a starting point that is predicted by adding one pitch period to the prior window starting point. Then the search process determines the exact starting point. Four bits are employed to specify the deviation (referred to as "jitter") of the starting point from the predicted value. A frame whose window location is so determined can be referred to as a "jittered frame".

It has been found that a normal bit allocation for jitter is sometimes inadequate due to an occurrence of an onset or a major change in pitch from the prior frame. In order to have greater control of the window location one can introduce as an alternative an option of having a "reset frame" wherein a larger bit allocation is dedicated to specifying the window location. For each periodic frame, a separate search is performed for each of the two options for specifying the window location, and a decision process compares the peaks of the residual energy profile for the two cases to select whether or not to treat the frame as a jittered frame or as a reset frame. If a reset frame is chosen, then a "reset condition" is said to occur and a larger number of bits is used to more accurately specify the needed window location.

For certain combinations of pitch value and window positions, it is possible that a subframe may contain no window at all. However, rather than having an all-zero fixed excitation for such a subframe, it has been found to be helpful to allocate bits to obtain an excitation signal for the subframe, even though there is no window. This may be considered as a deviation from the general philosophy of limiting excitations to be within the windows. A two pulse method simply searches the even sample positions in the subframe for the best location of one pulse, and searches the odd sample positions for the best location of a second pulse.

Another approach in accordance with a further aspect of this invention uses adaptive codebook (ACB) guided windowing, where an extra window is included in the otherwise windowless subframe.

In the ACB-guided windowing method, the coder examines the adaptive codebook (ACB) signal segment for the current windowless subframe. This is the segment of duration one subframe taken from the composite excitation one pitch period earlier. The peak of this segment is found and chosen as the center of the special window for the current subframe. No bits are needed to identify the location of this window. The pulse excitation in this window is then found according to the usual procedure for subframes that are not windowless. The same number of bits can be used for this subframe as for any other "normal" subframe, except that no bits are required to encode the window positions.

Figure 7:
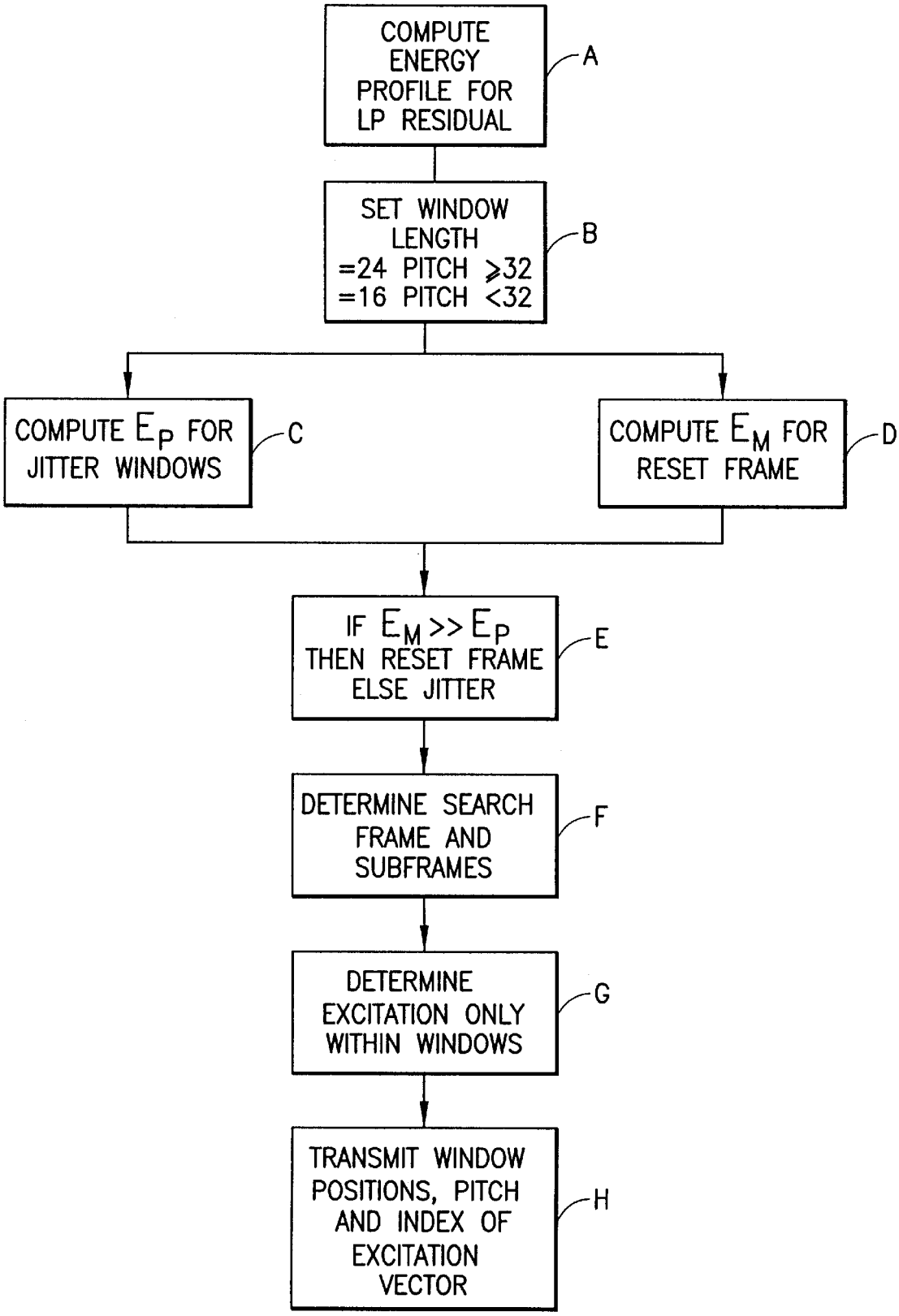
FIG. 7 is a logic flow diagram in accordance with a method of this invention.

Referring now to FIG. 7, a logic flow diagram of a method in accordance with this invention is presented. At Step A the method computes the energy profile for the LP residual. At Step B the method sets the window length equal to 24 for pitch period ≧32 and 16 for a pitch period <32. After Step B both Step C and Step D can be executed. At Step C the method computes window positions using previous frame windows and pitch and computes the energy within windows, E, to find the maximum value, $E_p$. that gives the best jitter. In Step D the method finds the window positions which capture the most energy of the LP residual, $E_m$, for the reset frame case.

As was described above, jitter is the shift of the window position with respect to the position given by the previous frame, plus the pitch interval. Distances between windows in the same frame are equal to the pitch interval. For reset frames the position of the first window is transmitted, and all other windows in the frame are considered to be at a distance from the prior window that is equal to the pitch interval.

For erratic frames and weak periodic frames there is one window per subframe, with the window position determined by the energy peak. For each window the window position is transmitted. For periodic (voiced) frames, only the position of the first window is transmitted (with respect to the previous frame for the "jittered" frames, and absolutely for reset frames). Given the first window position, the remainder of the windows are placed at the pitch interval.

Returning to FIG. 7, in Step E the method compares $E_p$ and $E_m$, and declares a reset frame if $E_m >> E_p$, otherwise the method uses the jitter frame. At Step F the method determines search frame and search subframes such that each subframe has an integer number of windows. At Step G the method searches for the optimum excitation inside the windows. Outside the windows the excitation is set to zero. Two windows in the same subframe are constrained to have the same excitation. Finally, at Step H the method transmits the window positions, pitch, and the index of the excitation vector for each subframe to the decoder 10, which uses these values to reconstruct the original speech signal.

It should be realized that the logic flow diagram of FIG. 7 can also be viewed as a block diagram of circuitry for coding speech in accordance with the teachings of this invention.

A discussion will now be made of the three classification embodiment that was briefly mentioned above. In this embodiment the basic frames are classified as being one of voiced, transition (erratic), or unvoiced. A detailed discussion of this embodiment will now be presented, in conjunction with the FIGS. 8–10. Those skilled in the art may notice some overlap of subject matter with the four types of basic frame classification embodiment described previously.

Generally, in unvoiced frames the fixed codebook contains a set of random vectors. Each random vector is a segment of a pseudo-random sequence of ternary (−1,0 or +1) numbers. The frame is divided into three subframes and the optimal random vector and the corresponding gain are determined in each subframe using AbS. In unvoiced frames, the contribution of the adaptive codebook is ignored. The fixed codebook contribution represents the total excitation in that frame.

To achieve an efficient excitation representation, and in accordance with an aspect of this invention described previously, the fixed codebook contribution in a voiced frame is constrained to be zero outside of selected intervals (windows) within that frame. The separation between two successive windows in voiced frames is constrained to be equal to one pitch period. The locations and sizes of the windows are chosen so that they jointly represent the most critical segments of the ideal fixed codebook contribution. This technique, which focuses the attention of the encoder on the perceptually important segments of the speech signal, ensures efficient encoding.

A voiced frame is typically divided into three subframes. In an alternative embodiment, two subframes per frame has been found to be a viable implementation. The frame and subframe length may vary (in a controlled manner). The procedure for determining these lengths ensures that a window never straddles two adjacent subframes.

The excitation signal within a window is encoded using a codebook of vectors whose components are ternary valued. For higher encoding efficiency, multiple windows located within the same subframe are constrained to have the same fixed codebook contribution (albeit shifted in time). The best code-vector and the corresponding gain are determined in each subframe using AbS. An adaptive excitation that is derived from the past encoded excitation using a CELP type approach is also used.

The encoding scheme for the fixed codebook excitation in transition class frames is also based on a system of windows. Six windows are allowed, two in each subframe. These windows may be placed anywhere in the subframe, may overlap each other, and need not be separated by one pitch period. However windows in one subframe may not overlap windows in another. Frame and subframe lengths are adjustable as in the voiced frames, and AbS is used to determine the optimal fixed codebook (FCB) vectors and gains in each subframe. However, unlike the procedure in voiced frames, an adaptive excitation is not used.

With regard to the classification of frames, the presently preferred speech coding model employs a two-stage classifier to determine the class (i.e., voiced, unvoiced or transition) of a frame. The first stage of the classifier determines if the current frame is unvoiced. The decision of the first stage is arrived at through an analysis of a set of features that are extracted from the modified residual. If the first-stage of the classifier declares a frame as "not Unvoiced", the second stage determines if the frame is a voiced frame or a transition frame. The second stage works in "closed-loop" i.e., the frame is processed according to the encoding schemes for both transition and voiced frames and the class which leads to a lower weighted mean-square error is selected.

Figure 8:
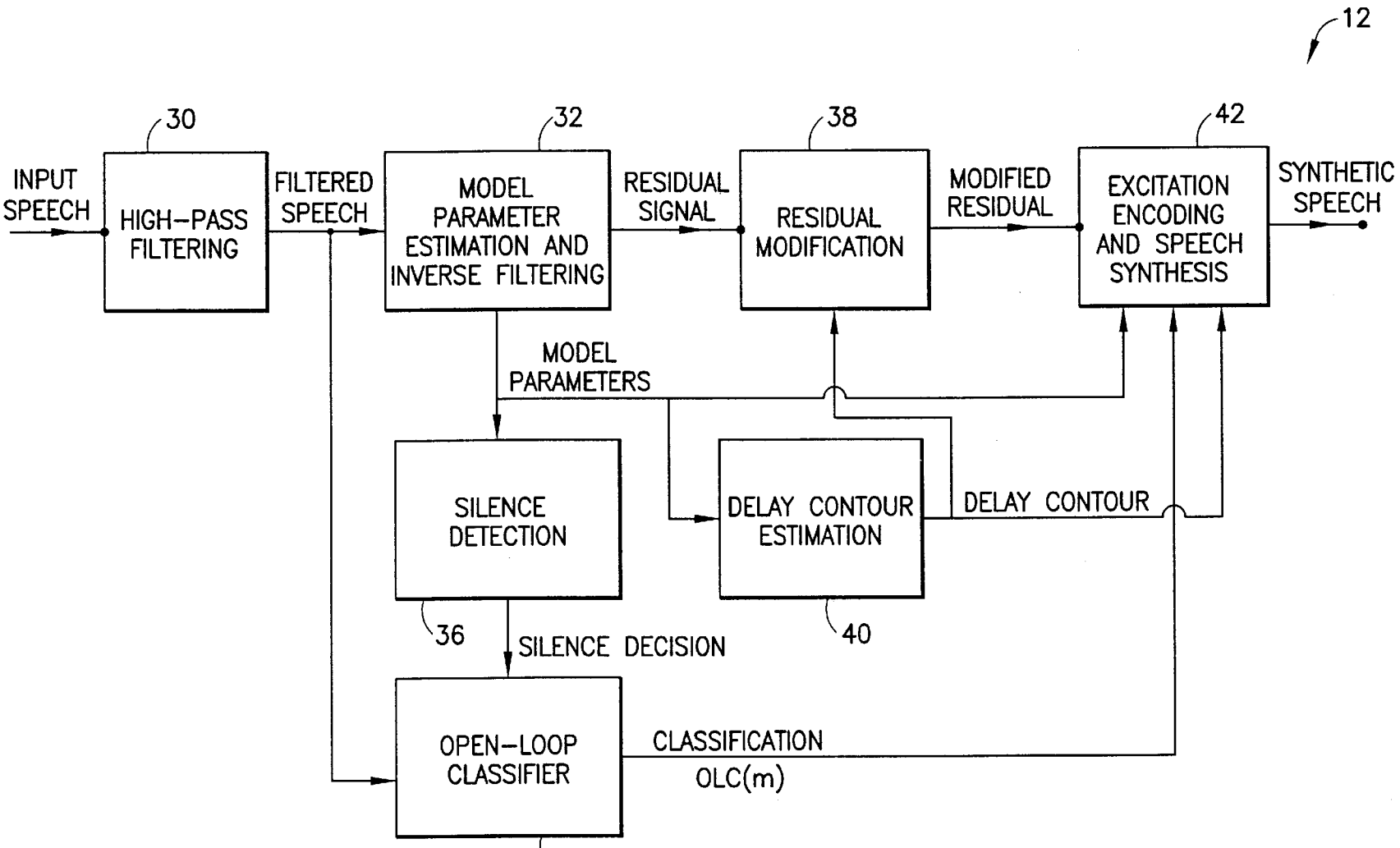
FIG. 8 is a block diagram of the speech coder in accordance with a presently preferred embodiment of this invention.

FIG. 8 is a high-level block diagram of the speech encoding model 12 that embodies the foregoing principals of operation.

The input sampled speech is high-pass filtered in block 30. A Butterworth filter implemented in three bi-quadratic sections is used in the preferred embodiment, although other types of filters or numbers of segments could be employed. The filter cutoff frequency is 80Hz, and the transfer function of the filter 30 is:

$$H_{hpf}(Z) = \prod_{j=1}^{3} H_j(Z)$$

where each section $H_j(z)$ is given by:

$$H_j(Z) = \frac{\alpha_{j0} + \alpha_{j1}z^{-1} + \alpha_{j2}z^{-2}}{b_{j0} + b_{j1}z^{-1} + b_{j2}z^{-2}}.$$

The high-pass filtered speech is divided into non-overlapping "frames" of 160 samples each.

In each frame, m, a "block" of 320 samples (the last 80 samples from frame "m−1", 160 samples from frame "m", and the first 80 samples from frame "m+1") is considered in the Model Parameter Estimation and Inverse Filtering unit 32. In the presently preferred embodiment of this invention the block of samples is analyzed using the procedures described in Section 4.2 (Model Parameter Estimation) of the TIA/EIA/IS-127 document that describes the Enhanced Variable Rate Coder (EVRC) speech encoding algorithm, and the following parameters are obtained: the unquantized linear prediction coefficients for the current frame, (a) the unquantized LSPs for the current frame, $\Omega(m)$; the LPC prediction gain, $\gamma_{lpc}(m)$; the prediction residual, $\epsilon(n)$, n=0, . . . 319 corresponding to samples in the current block; the pitch delay estimate, $\tau$; the long-term prediction gain in two halves of the current block, $\beta$, $\beta_1$; and the bandwidth expansion correlation coefficient, $R_w$.

The silence detection block 36 makes a binary decision about the presence or absence of speech in the current frame. The decision is made as follows.

(A) The "Rate determination algorithm" in Section 4.3 (Determining the Data Rate) of the TIA/EIA/IS-127 EVRC document is employed. The inputs to this algorithm are the model parameters computed in the previous step and the output is a rate variable, Rate (m), which can take on the values 1, 3 or 4 depending on the voice activity in the current frame.

(B) If the Rate(m)=1, then the current frame is declared as a silent frame. If not, (i.e. if Rate(m)=3 or 4), the current frame is declared as active speech.

Note that this embodiment of the invention uses the rate variable of EVRC only for the purpose of detecting silence. That is, the Rate(m) does not determine the bit-rate of the encoder 12 as in conventional EVRC.

A delay contour is computed in delay contour estimation unit 40 for the current frame by interpolating the frame delays through the following steps.

(A) Three interpolated delay estimates, d (m', j), j=0,1,2 are calculated for each subframe, m'=0,1,2, using the interpolation equations in Section 4.5.4.5 (interpolated Delay Estimate Calculation) of the TIA/EIA/IS-127 document.

(B) The delay contour, $\tau_c(n)$ is then calculated for each of the three subframes in the current frame using the equations in Section 4.5.5.1 (Delay Contour Computation) of the TIA/EIA/IS-127 document.

In the residual modification unit 38 the residual signal is modified according to the RCELP residual modification algorithm. The objective of the modification is to ensure that the modified residual displays a strong correlation between samples separated by a pitch period. Suitable steps of the modification process are listed in Section 4.5.6 (Modification of the Residual) of the TIA/EIA/IS-127 document.

Those skilled in the art will notice that in standard EVRC, residual modification in a subframe is followed by the encoding of excitation in that subframe. In the present invention's voice encoding, however, the modification of the residual for the entire current frame (all three subframes) is performed prior to encoding the excitation signal in that frame.

It is again noted that the foregoing references to RCELP are made in the context of a presently preferred embodiment, and that any CELP-type technique could be employed in lieu of the RCELP technique.

The open-loop classifier unit 34 represents the first of the two stages in the classifier that determines the nature (voiced, unvoiced or transition) of the speech in each frame. The output of the classifier in frame, m, is OLC(m) whose value can be UNVOICED or NOT UNVOICED. This decision is taken by analyzing a block of 320 samples of the high-pass filtered speech. This block, x(k), k=0, 1 . . . 319 is obtained in frame "m", as in model parameter estimation, from the last 80 samples of frame "m−1", 160 samples from frame "m" and the first 80 samples from frame "m+1". Next, the block is divided into four equal-length subframes, (80 samples each) j=0,1,2,3. Four parameters are then computed from the samples in each subframe j: Energy E(j), Peakiness Pe(j), Zero-Crossing Rate ZCR(j), and the Long-Term Prediction Gain LTPG(j). These parameters are next used to obtain a set of classification decisions, one per subframe. The subframe level classifier decisions are then combined to generate a frame-level decision which is the output of the open-loop classifier unit 34.

The following is noted with regard to the computation of subframe parameters.

Energy

The subframe energy is defined as:

$$E(j) = 10\log_{10}\left(\sum_{k=80j}^{80j+79}(x(k))^2\right)$$

j=0, 1, 2, 3.

Peakiness

The peakiness of the signal in a subframe is defined as:

$$Pe(j) = \frac{\left(\sum_{k=80j}^{80j+79}(x(k))^2\right)^{0.5}}{\sum_{k=80j}^{80j+79}|x(k)|}$$

Zero Crossing Rate

The Zero-crossing rate is computed for each subframe through the following steps:

An average Av(j) of the samples is calculated in each subframe j:

$$Av(j) = \frac{1}{80}\sum_{k=80j}^{80j+79}x(k)$$

The average value is subtracted from all samples in the subframe:

y(k)=x(k)−Av(j) k=80j . . . 80j+79

The Zero-crossing rate of the subframe is defined as:

$$ZCR(j) = \frac{1}{79}\sum_{k=80j}^{80j+78}\partial(y(k)*y(k+1)<0)$$

where the function $\delta(Q)=1$ if Q is TRUE and 0 if Q is FALSE.

Long-term Prediction Gain

The long-term prediction gain (LTPG) is computed from the values of $\beta$ and $\beta_1$ obtained in the model parameter estimation process:

LTPG(0)=LTPG(3) (LTPG(3) here is the value assigned in the previous frame)

LTPG(1)=($\beta_1$+LTPG(0))/2

LTPG(2)=($\beta_1$+$\beta$)/2

LTPG(3)=$\beta$

Subframe Level Classification

The four subframe parameters computed above are then utilized to make a classification decision for each subframe, j, in the current block. For subframe j a classification variable CLASS(j) whose value can be either UNVOICED or NOT UNVOICED is computed. The value of CLASS(j) is obtained by performing the sequence of steps detailed below. In the following steps, the quantities, "Voiced Energy" Vo(j), "Silence Energy" Si(j) and "Difference Energy" Di(j)=Vo(j)-Si(j) represent the encoder's estimate of the average energy of voiced subframes, silent subframes, and the difference between these quantities. These energy estimates are updated at the end of each frame using a procedure that is described below.

Procedure:

```
If E(j)<30, CLASS(j)=UNVOICED
Else if the E(j)<0.4*Vo(m)
  if E|(j-1 mod 3)-E(j)<25, CLASS(j)=UNVOICED
  Else CLASS(j)=NOT UNVOICED
Else if ZCR(j)<0.2
  if E(j)<Si(m)+0.3*Di(m) AND Pe(j)<2.2 AND |E(j-1
    mod 3)-E(j)|<20, CLASS(j)=UNVOICED
  Else if LTPG(j)<0.3 AND Pe(j)<1.3 AND E(j)<Si(m)+
    0.5*Di(m) CLASS(j)=UNVOICED;
  Else CLASS(j)=NOT UNVOICED
Else if ZCR(j)<0.5
  if E(j)<Si(m)+0.3*Di(m) AND Pe(j)<2.2 AND |E(j-1
    mod 3)-E(j)|<20 CLASS(j)=UNVOICED
  Else if LTPG(j)>0.6 OR Pe(j)>1.4 CLASS(j)=NOT
    UNVOICED
  Else if LTPG(j)<0.4 AND Pe(j)<1.3 AND E(j)<Si(mj)+
    0.6*Di(m) CLASS(j)=UNVOICED
  Else if ZCR(j)>0.4 AND LTPG(j)<0.4 CLASS(j)=
    UNVOICED
  Else if ZCR(j)>0.3 AND LTPG(J)<0.3 AND Pe(j)<1.3
    CLASS(j)=UNVOICED
  Else CLASS(j)=UNVOICED
Else if ZCR(j)<0.7
  If E(j)<Si(m)+0.3*Di(m) AND Pe(j)<2.2 AND |E(j-1
    mod 3)-E(j)|<20 CLASS(j)=UNVOICED
  Else if LTPG(j)>0.7 CLASS(j)=NOT UNVOICED
  Else if LTPG(j)<0.3 AND Pe(j)>1.5 CLASS(j)=NOT
    UNVOICED
  Else if LTPG(j)<0.3 AND Pe(j)>1.5 CLASS(j)=
    UNVOICED
  Else if LTPG(j)>0.5
    If Pe(j)>1.4 CLASS(j)=NOT UNVOICED
    Else if E(j)>Si(m)+0.7Di(m), CLASS(j)=
      UNVOICED
    Else CLASS(j)=UNVOICED
  Else if Pe(j)>1.4 CLASS(j)=NOT UNVOICED
  Else CLASS(j)=UNVOICED
Else
  If Pe(j)>1.7 OR LTPG(j)>0.85 CLASS(j)=NOT
    UNVOICED
  Else CLASS(j)=UNVOICED
```

Frame Level Classification

The classification decisions obtained for each subframe are then used to make a classification decision, OLC(m), for the entire frame. This decision is made as follows.

Procedure:

```
If CLASS(0)=CLASS(2)=UNVOICED AND CLASS
  (1)=NOT UNVOICED
  If E(1)<Si(m)+0.6 Di(m) AND Pe(1)<1.5 AND |E(1)-
    E(0)|<10 AND |E(1)-E(2)|<10 AND ZCR(1)>0.4
    OLC(M)=UNVOICED
  Else OLC(m)=NOT UNVOICED
Else if CLASS(0)=CLASS(L)=UNVOICED AND
  CLASS(2)=NOT UNVOICED
  If E(2)<Si(m)+0.6Di(m) AND Pe(2)<1.5 AND |E(2)-
    E(1)|<10 AND ZCR(2)>0.4 OLC(M)=UNVOICED
  Else OLC(m)=NOT UNVOICED.
Else if CLASS(0) CLASS(1)=CLASS(2)=UNVOICED
  OLC(M)=UNVOICED.
Else if CLASS(0)=UNVOICED, CLASS(1)=CLASS(2)=
  NOT UNVOICED, OLC(m)=NOT UNVOICED
Else if CLASS(0)=NOT UNVOICED, CLASS (1)=
  CLASS(2)=UNVOICED OLC(m)=UNVOICED
Else OLC(m)=NOT UNVOICED.
```

Update of Voice Energy, Silence Energy and Difference Energy

The voice energy is updated if the current frame is the third consecutive voiced frame, as follows.

Procedure:

If OLC(m)=OLC(m−1)=OLC(m−2)=VOICED, THEN $Vo(M)=10\log_{10}(0.94*10^{0.1vo(m)}+0.06*10^{0.1E(0)})$ Vo(m)=MAX(Vo(m), E(1), E(2))

Else Vo(m)=Vo(m−1) (No update of Voice Energy)

The silence energy is updated if the current frame has been declared as a silent frame.

Procedure:

If SILENCE(m)=TRUE, Si(M)=[e(0)+e(1)]/2.0

The difference energy is updated as follows.

Procedure:

Di(m)=Vo(m)−Si(m)

If Di(m)<10.0

Di(m)=10, Vo(m)=Si(m)+10

Figure 9:
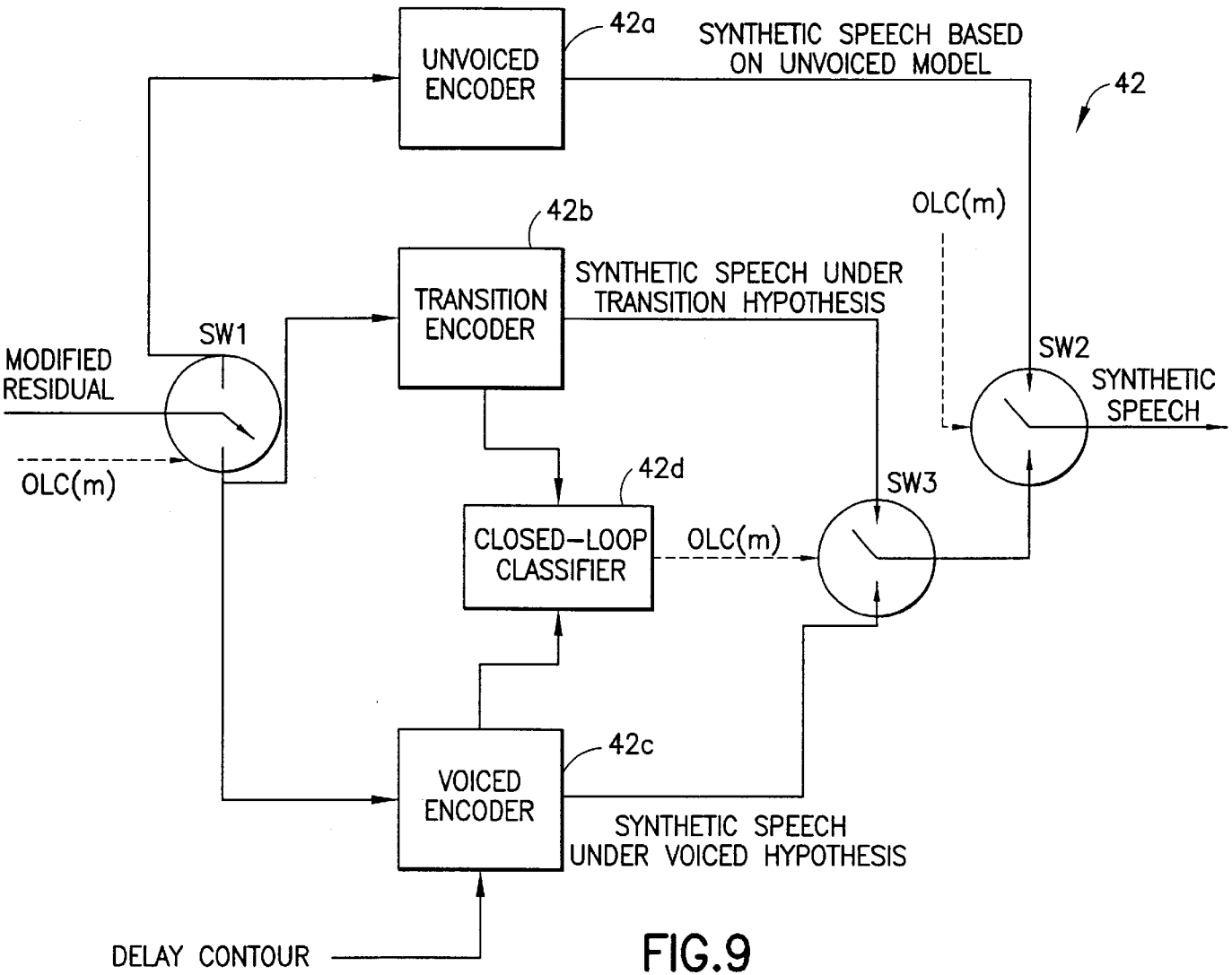
FIG. 9 is a block diagram of an excitation encoder and speech synthesis block shown in FIG. 8.

An excitation encoding and speech synthesis block 42 of FIG. 8 is organized as shown in FIG. 9. First, the decision of the open-loop classifier 34 is used to direct the modified residual in each frame to the encoder(s) that is/are appropriate for that frame. If OLC(m)=UNVOICED, then the unvoiced encoder 42*a* is employed. If OLC(m)=NOT UNVOICED, then both a transition encoder 42*b* and a voiced encoder 42*c* are invoked, and a closed-loop classifier 42*d* makes a decision CLC(m) whose value may be either TRANSITION or VOICED. The decision of the closed-loop classified 42*d* depends on the weighted errors resulting from the synthesis of the speech using the transition and voiced encoders 42*b* and 42*c*. The closed-loop classifier 42*d* chooses one of the two encoding schemes (transition or voiced) and the chosen scheme is used to generate the synthetic speech. The operation of each encoding system 42*a*–42*c* and the closed-loop classifier 42*d* are described in detail below.

Referring first to the voiced encoder 42*c* of FIG. 9, it is first noted that the encoding process can be summarized via the following sequence of steps, which are each described in further detail below and shown in FIG. 11.

(A) Determine the window boundaries.

(B) Determine the search subframe boundaries.

(C) Determine the FCB vector and gain in each subframe.

(A) The determination of the window boundaries for voiced frames.

Inputs

Endpoint of the previous search frame;

Location of the last "epoch" in the previous search frame;

Epochs represent the centers of windows of important activity in the current frame; and The modified residual for sample indices from −16 to 175 relative to the beginning of the current basic frame.

Outputs

Positions of windows in the current frame.

Procedure

Figure 10:
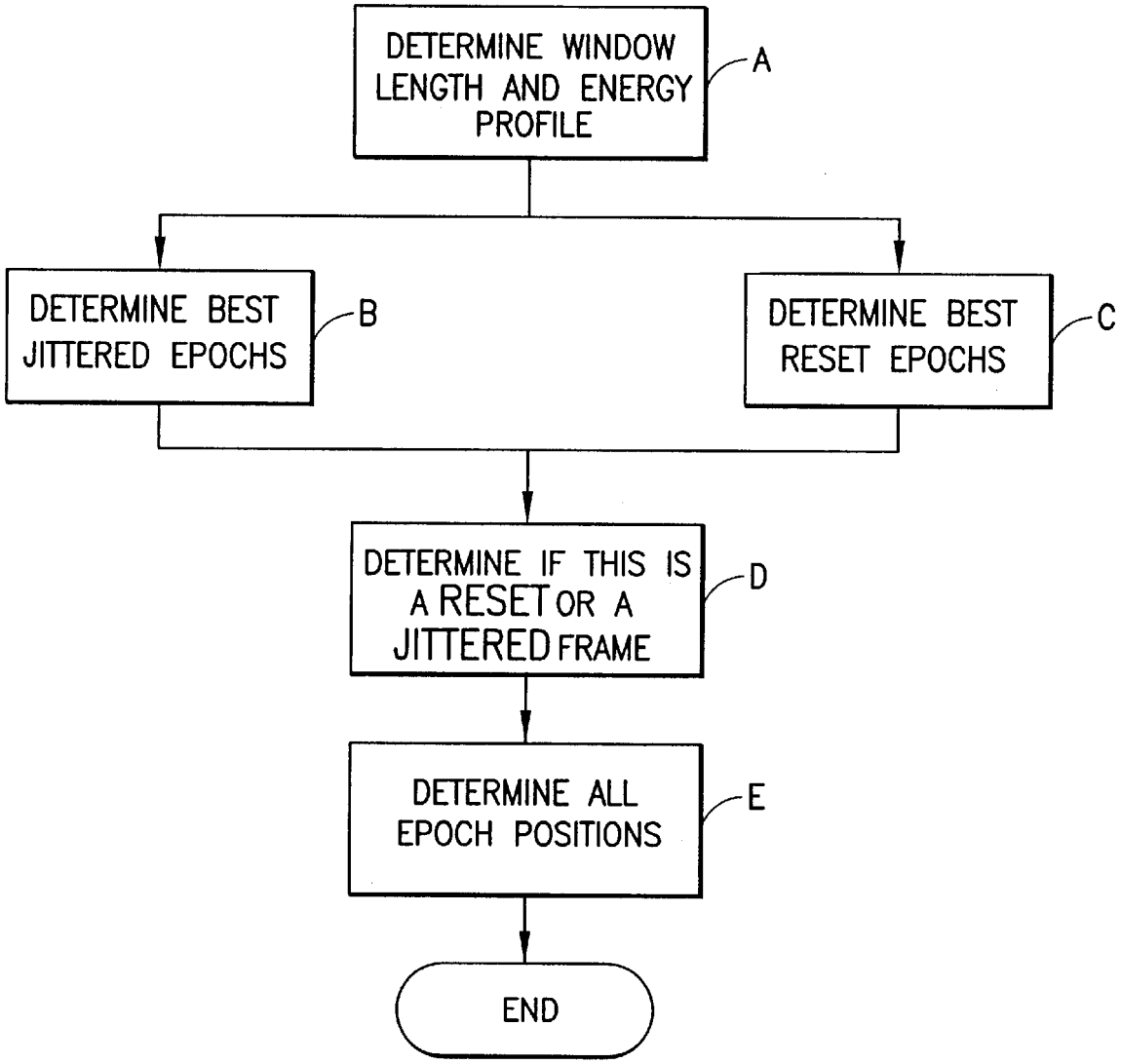
FIG. 10 is a simplified logic flow diagram that illustrates the operation of the encoder of FIG. 8.

A set of windows centered at "epochs" is identified in voiced frames using the procedure described in the flowchart of FIG. 10, which is similar in some respects to the flowchart shown in FIG. 7. In voiced frames, the intervals of strong activity in the modified residual generally recur in a periodic manner. The presently preferred voice encoder 12 exploits this property by enforcing the constraint that the epochs in voiced frames must be separated from each other by one pitch period. To allow some flexibility in placing the epochs, a "jitter' is permitted i.e. the distance between the first epoch in the current search frame and the last epoch in the previous frame can be chosen between pitch −8 and pitch +7. The value of the jitter (an integer between −8 and 7) is transmitted to the decoder 10 in the receiver (it being noted that quantized value such as the one obtained by restricting the jitter to even integers may be used).

In some voiced frames, however, even the use of jittered windows does not allow sufficient flexibility to capture all the important signal activity. In those cases, a "reset" condition is allowed and the frame is referred to as a VOICED RESET frame. In voiced reset frames, the epochs in the current frame are separated from each other by one pitch period, but the first epoch may be positioned anywhere in the current frame. If a voiced frame is not a reset frame, then it is referred to as a NON-RESET VOICED frame or a JITTERED VOICED frame.

The individual blocks of the flowchart of FIG. 10 will now be described in further detail.

(Block A) Determination of Window Lengths and Energy Profile

The length of the windows used in a voiced frame is chosen depending on the pitch period in the current frame. First, the pitch period is defined as is done in conventional EVRC for each subframe. If the maximum value of the pitch period in all subframes of the current frame is greater than 32, a window length of 24 is chosen, if not, the window length is set to 16.

A window is defined around each epoch as follows. If an epoch lies in location, e, the corresponding window of length L extends from sample index e−L/2 to sample index e+L/2−1.

A "tentative search frame" is then defined as the set of samples starting from the beginning of the current search frame to the end of the current basic frame. Also, an "epoch search range" is defined, starting L/2 samples after the beginning of the search frame and ending at the end of the current basic frame (L is the window length in the current frame). The samples of the modified residual signal in the tentative search frame are denoted as e(n), n=0 . . . N−1, where N is the length of the tentative search frame. The pitch value for each sample in the tentative search frame is defined as the pitch value of the subframe in which that sample lies and is denoted as pitch(n), n=0, . . . N−1.

A set of two "energy profiles" is calculated at each sample position in the tentative search frame. The first, a local energy profile, LE_Profile, is defined as a local average of the energy of the modified residual:

$$LE_Profile(n)=[e(n-1)^2+e(n)^2+e(n+1)^2]/3.$$

The second, a pitch-filtered energy profile, PFE_Profile, is defined as follows:

If n+pitch(n)<N (the sample which is a pitch period after the current sample lies inside the tentative search frame):

PFE_Profile(n)=0.5*[LE_Profile(n)+LE_Profile(n+pitch(n))]

Else

PFE_Profile(n)=LE_Profile(n)

(Block B) Determination of the Best Littered epochs

The best value of the jitter (between −8 and 7) is determined to evaluate the effectiveness of declaring the current frame as a JITTERED VOICED frame.

For each Candidate Jitter Value, j:

1. A track defined as the collection of epochs resulting from the choice of that candidate jitter value is determined through the following recursion:

Initialization:

epoch[0]=LastEpoch+j+pitch[subframe[0]]

Repeat for n=1,2 . . . as long as epoch[n] is in the epoch search range epoch[n]=epoch[n−1]+Pitch(epoch[n−1])

2. The position and amplitude of the track peak, i.e., the epoch with the maximum value of the local energy profile on the track is then computed.

The optimal jitter value, j*, is defined as the candidate jitter with the maximum track peak. The following quantities are used later, for the purpose of making a reset decision:

J_TRACK_MAX_AMP, the amplitude of the track peak corresponding to the optimal jitter.

J_TRACK_MAX_POS, the position of the track peak corresponding to the optimal jitter.

(C) Determination of the Best Reset Epochs

The best position, reset_epoch, to reset the epochs to is determined in order to evaluate the effectiveness of declaring the current frame as a RESET VOICED frame. The determination is as follows.

The value of reset_epoch is initialized to the location of the maximum value of the local energy profile, LE_Profile (n), in the epoch search range.

An initial "reset track" which is a sequence of periodically placed epoch positions starting from the reset_epoch is defined. The track is obtained through the recursions:

Initialization:

epoch[0]=reset_epoch

Repeat for n=1,2 . . . as long as epoch[n] is in epoch search range epoch[n]=epoch[n−1]+Pitch (epoch[n−1])

The value of reset_epoch is re-computed as follows. Among all sample indices, k, in the epoch search range, the earliest (least value of k) sample which satisfies the following conditions (a)–(e) is chosen:

(a) The sample k lies within 5 samples of an epoch on the reset track.

(b) The pitch-filtered energy profile, PFE_Profile, has a local maxima, defined as below, at k:

PFE_Profile(k)>PFE_Profile(k+j), for j=−2, −1, 1,2

(c) The value of the pitch-filtered energy profile at k is significant compared to its value at the reset_epoch:

PFE_Profile(k)>0.3*PFE_Profile(reset_epoch)

(d) The value of the local energy profile at k is significant compared to the value of the pitch-filtered energy profile:

LE_Profile(k)>0.5*PFE_Profile(k)

(e) The location of k is sufficiently (e.g. 0.7*pitch(k) samples) distant from the last epoch.

If a sample k that satisfies the above conditions is found, the value of reset_epoch is changed to k.

The final reset track is determined as the sequence of periodically placed epoch positions starting from the reset_epoch and is obtained through the recursions:

Initialization:

epoch[0]=reset_epoch Repeat for n=1,2 . . . as long as epoch[n] is in the epoch search range epoch[n]=epoch[n−1]+Pitch (epoch[n−1])

The position and magnitude of the "reset track peak" which is the highest value of the pitch-filtered energy profile on the reset track is obtained. The following quantities are used to make the decision on resetting the frame.

$R_{13}$ TRACK_MAX_AMP, the amplitude of the reset track peak.

$R_{13}$ TRACK_MAX_POS, the position of the reset track peak.

(Block D) Decision on Resetting Frame

The decision on resetting the current frame is made as follows:

IF {(J_TRACK_MAX_AMP/$R_{13}$ TRACK_MAX_AMP<0.8) OR the previous frame was UNVOICED} AND {|J_TRACK_MAX$_{13}$ POS−$R_{13}$ TRACK_MAX$_{13}$ POS|>4d} THEN the current frame is declared as a RESET VOICED frame;

Else the current frame is declared as a NON-RESET VOICED FRAME.

(Block E) Determination of Epoch Positions

The quantity, FIRST$_{13}$ EPOCH, which refers to the tentative location of the first epoch in the current search frame, is defined as follows:

If the current frame is a RESET frame:

FIRST$_{13}$ EPOCH=$R_{13}$ TRACK_MAX$_{13}$ POS

Else

FIRST$_{13}$ EPOCH=J TRACK_MAX$_{13}$ POS

Given FIRST$_{13}$ EPOCH, the tentative position of the first epoch, a set of epoch locations that succeed this epoch are determined as follows:

Initialization:

epoch[0]=FIRST$_{13}$ EPOCH Repeat for n=1,2 . . . as long as epoch[n] is in the epoch search range epoch[n]=epoch[n−1]+Pitch(epoch[n−1])

If the previous frame was voiced and the current frame is a reset voiced frame, epochs may be introduced to the left of FIRST$_{13}$ EPOCH using the procedure below:

Procedure:

Repeat for n=1,2 . . . as long as epoch[−n] is in the epoch search range epoch[−n]=epoch[−n+1]−Pitch (epoch[−n])

Delete all epochs that do not satisfy the conditions:

k>0.1*pitch(subframe[0]) and k-LastEpoch>0.5*pitch (subframe(0))

Re-index the epochs such that the epoch that is left-most (earliest) is epoch[0].

If the current frame is a reset voiced frame, the positions of the epochs are smoothed using the procedure below:

Procedure:

Repeat for n=1,2 . . . K epoch[n]=epoch[n]−(K−n)*[epoch[0]−LastEpoch]/(K+1)

where LastEpoch is the last epoch in the previous search frame.

The objective of smoothing epoch positions is to prevent an abrupt change in the periodicity of the signal.

If the previous frame was not a voiced frame and the current frame is a reset voiced frame, introduce epochs to the left of the First Epoch using the procedure below:

Determine AV$_{13}$ FRAME, and PK$_{13}$ FRAME, the average and peak values respectively, of the energy profile for samples in the current basic frame.

Next, introduce epochs to the left of START$_{13}$ EPOCH as follows:

Repeat for n=1,2 . . . as long as epoch[−n] is in the epoch search range epoch[−n]=epoch[−n+1]−Pitch (epoch[−n]) until the beginning of the epoch search range is reached.

Define WIN_MAX[n] as the maximum value of the local energy contour for samples inside the window defined by each newly introduced epoch, epoch[−n], n=1,2 . . . K. Verify that all newly introduced epochs satisfy the following condition: (WIN$_{13}$ MAX>0.13 PK$_{13}$ FRAME) and (WIN$_{13}$ MAX>1.5 AV$_{13}$ FRAME)

If any newly introduced epoch does not satisfy the above conditions, eliminate that epoch and all epochs to its left.

Re-index the epochs such that the earliest epoch in the epoch search range is epoch[0].

Figure 11:
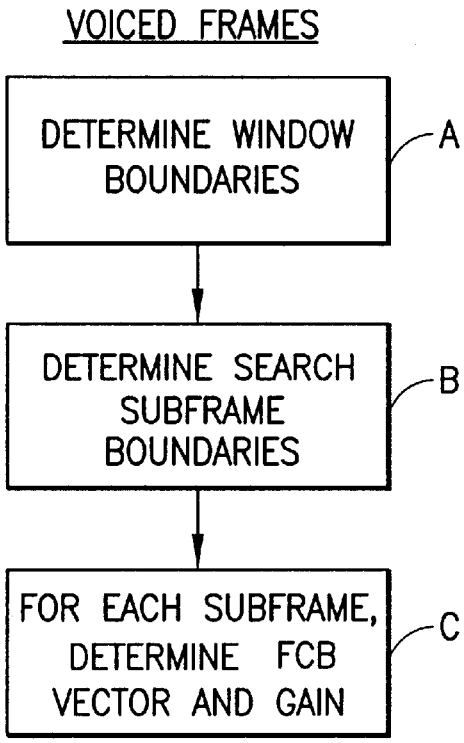
FIGS. 11–13 are logic flow diagrams showing the operation of the encoder of FIG. 8, in particular the excitation encoder and speech synthesis block, for voiced frames, transition frames, and unvoiced frames, respectively.

Having thus determined the window boundaries for voiced frames, and still referring to the voiced encoder 42c of FIG. 9, a description is now made of a presently preferred technique for determining search subframe boundaries for voiced frames (FIG. 11, Block B).

Inputs

Endpoint of the previous search frame; and

Position of windows in the current frame.

Outputs

Position of search subframes in the current frame.

Procedure

For each subframe (0,1,2) do:

Set the beginning of the current search subframe equal to the sample following the end of the last search subframe.

Set the last sample of the current search subframe equal to the last sample of the current basic subframe.

If the last sample in the current basic subframe lies inside a window, the current search subframe is re- defined as follows:

If the center of that window lies inside the current basic subframe, then extend the current search subframe until the end of the window, i.e. set the end of the current search subframe as the last sample of the window which straddles the end of the basic subframe (overlapping window).

Else (the center of the window falls in the next basic subframe)

If the current subframe index is 0 or 1, (first two subframes), then set the end of the current search subframe at the sample that precedes the beginning of the overlapping window (exclude the window from the current search subframe).

Else (if this is the last subframe), set the end of the current search subframe as the index of the sample that is eight samples before the beginning of the overlapping window (exclude the window from this search subframe and leave additional room before the window to allow adjustment of this window position in the next frame).

Repeat this procedure for the remaining subframes.

Having determined the search subframes, the next step is to identify the contribution of the fixed codebook (FCB) in each subframe (Block C of FIG. 11). Since the window positions depend on the pitch period, it is possible (especially for male speakers) that some search subframes may not have any windows. Such subframes are handled through a special procedure that is described below. In most cases, however, the subframes contain windows and the FCB contribution for these subframes is determined through the following procedure.

FIG. 11, Block C, the determination of FCB vector and gain for voiced subframes with windows is now described in detail.

Inputs

The modified residual in the current search subframe;

Locations of windows in the current search subframe;

The Zero Input Response (ZIR) of the weighted synthesis filter in the current subframe;

The ACB contribution in the current search subframe; and

The impulse response of the weighted synthesis filter in the current subframe.

Outputs

The index of the FCB vector selected;

The optimal gain corresponding to the FCB vector selected;

The synthesized speech signal; and

The weighted squared-error corresponding to the optimal FCB vector.

Procedure

In voiced frames, an excitation signal derived from a fixed-codebook is chosen for samples inside the windows in a subframe. If multiple windows occur in the same search subframe, then all windows in that subframe are constrained to have an identical excitation. This restriction is desirable to obtain an efficient encoding of information. The optimal FCB excitation is determined through an analysis by synthesis (AbS) procedure. First, a FCB target is obtained by subtracting the ZIR (Zero Input Response) of the weighted synthesis filter and the ACB contribution from the modified residual. The fixed-codebook FCB_V changes with the value of the pitch and it is obtained through the following procedure.

If the window length (L) equals 24, the 24-dimensional vectors in $FCB_{13}$ V are obtained as follows:

(A) Each code-vector is obtained by placing zeros in all except 3 of the 24 positions in the window. The three positions are selected, by picking one position on each of the following tracks:

Track 0: Positions 0 3 6 9 12 15 18 21

Track 1: Positions 1 4 7 10 13 16 19 22

Track 2: Positions 2 5 8 11 14 17 20 23

(B) Each non-zero pulse in the chosen position may be +1 or −1, leading to 4096 code-vectors (i.e., 512 pulse position combinations multiplied by 8 sign combinations).

If the window length (L) equals 16, the 16-dimensional codebook is obtained as follows:

(A) Zeros are placed in all except 4 of the 16 positions. The non-zero pulses are placed, one each on the following tracks:

Track 0: Positions 0 4 8 12

Track 1: Positions 1 5 9 13

Track 2: Positions 2 6 10 14

Track 3: Positions 3 7 11 15

(B) Each non-zero pulse may be +1 or −1, leading again to 4096 candidate vectors (i.e., 256 position combinations, 16 sign combinations).

Corresponding to each code-vector, an unscaled excitation signal is generated in the current search subframe. This excitation is obtained by copying the code-vector into all windows in the current subframe, and placing zeros at other sample positions. The optimal scalar gain for this excitation is determined along with a weighted synthesis cost using standard analysis-by-synthesis. Since searching over all 4096 code-vectors is computationally expensive, the search is performed over a subset of the entire codebook.

In the first subframe, the search is restricted to code-vectors whose non-zero pulses match in sign with the signs of the back-filtered target signal at the corresponding positions in the first window of the search subframe. Those skilled in the art may recognize this techniques as one that is somewhat similar to the procedure used in EVRC for complexity reduction.

In the second and third subframes, the signs of the pulses on all tracks are constrained to be either identical to the signs chosen for the corresponding tracks in the first subframe, or exactly the opposite on every track. Only one bit is required to specify the sign of the pulses in each of the second and third subframes, and the effective codebook has 1024 vectors if L=24 and 512 vectors if L=16.

The optimal candidate is determined and the synthetic speech corresponding to this candidate is computed.

A description is now presented of a presently preferred technique to determine the FCB vector and gain for window-less voiced subframes.

Inputs

The modified residual in the current search subframe;

The ZIR of the weighted synthesis filter in the current subframe;

The ACB contribution in the current search subframe; and

The impulse response of the weighted synthesis filter in the current subframe.

Outputs

The index of the FCB vector selected;

The optimal gain corresponding to the FCB vector selected;

The synthesized speech signal; and

The weighted squared-error corresponding to the optimal FCB vector.

Procedure

In window-less voiced subframes, the fixed excitation is derived using the following procedure.

A FCB target is obtained by subtracting the ZIR of the weighted synthesis filter and the ACB contribution from the modified residual. A codebook, $FCB_{13}$ V is obtained through the following procedure:

Each code-vector is obtained by placing zeros in all except two positions in the search subframe. The two positions are selected by picking one position on each of the following tracks:

Track 0: Positions 0 2 4 6 8 10 . . . (odd numbered indices)

Track 1: Positions 1 3 5 7 9 . . . (even numbered indices).

Each non-zero pulse in the chosen position may be +1 or −1.

Since a search subframe may be as long as 64 samples, the codebook may contain as many as 4096 code vectors.

The optimal scalar gain for each code-vector can be determined along with a weighted synthesis cost, using standard analysis-by-synthesis techniques. The optimal candidate is determined and the synthetic speech corresponding to this candidate is computed.

Referring now to the transition encoder 42*b* of FIG. 9, in the presently preferred embodiment of this invention there are two steps in encoding transition frames. The first step is done as a part of the closed-loop classification process carried out by the closed-loop classifier 34 of FIG. 8, and the target rate for transitions is maintained at 4 kb/s to avoid a rate bias in the classification (if the rate would be higher, the classifier would be biased towards transitions). In this first step the fixed-codebook employs one window per subframe. The corresponding set of windows are referred to below as the "first set" of windows. In the second step, an extra window is introduced in each subframe generating a "second set" of windows. This procedure enables one to increase the rate for transitions only, without biasing the classifier.

Figure 12:
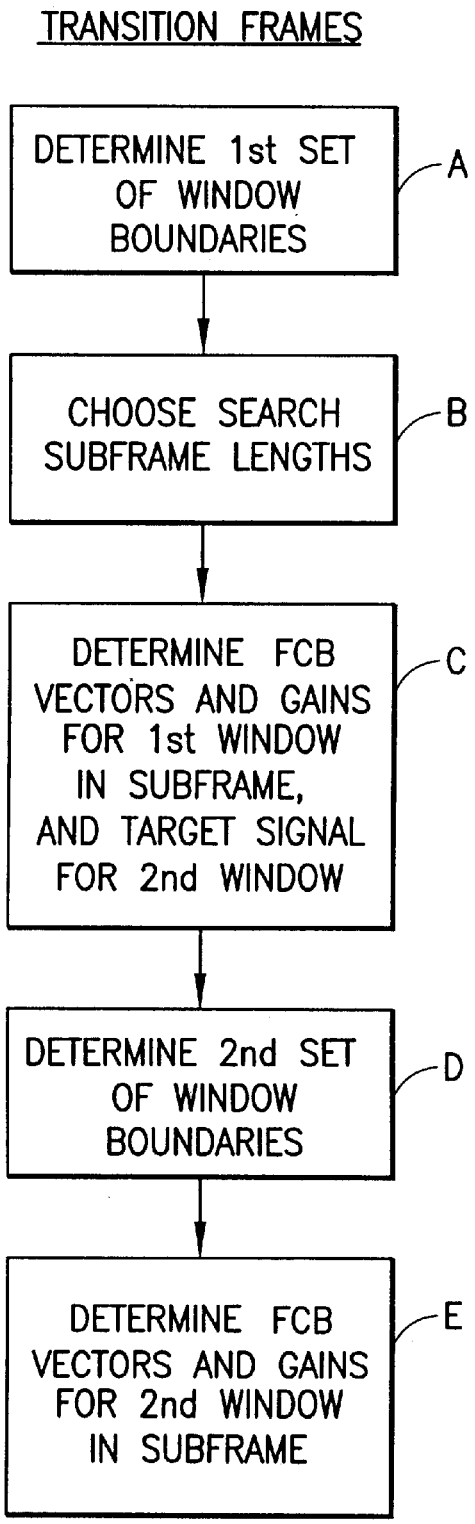

The encoding procedure for transition frames may be summarized through the following sequence of steps, which are illustrated in FIG. 12.

(A) Determine the "first set" of window boundaries.

(B) Choose the search subframe lengths.

(C) Determine the FCB vectors and gains for the first window in each subframe and the target signal for introducing excitation in a second set of windows.

(D) Determine the "second set" of window boundaries.

(E) Determine the FCB vectors and gains for the second window in each subframe.

Step A: The determination of the first set of window boundaries for transition subframes.

Inputs

Endpoint of the previous search frame; and

The modified residual for sample indices from −16 to 175; relative to the beginning of the current basic frame.

Outputs

Positions of windows in the current frame.

Procedure

The first three epochs are determined, one in each basic subframe. Windows of length 24 centered at the epochs are next defined, as in the voiced frames discussed above. While there is no constraint on the relative positions of epochs, it is desirable that the following four conditions (C1–C4) be satisfied:

(C1) If an epoch is in position, n, relative to the beginning of the search frame, then n must satisfy the equation: n=8*k+4 (k is an integer).

(C2) The windows defined by the epochs must not overlap each other.

(C3) The window defined by the first epoch must not extend into the previous search frame.

(C4) Epoch positions maximize the average energy of samples of the modified residual that are included in the windows defined by those epochs.

Step B: The determination of search subframe boundaries for transition frames.

This procedure can be identical to the previously described procedure for determining the search subframe boundaries in voiced frames.

Step C: The determination of FCB vector and gains for the first window in transition subframes.

This procedure is similar to the procedure used in voiced frames except in the following aspects:

(i) there is only one window in each search subframe; and (ii) in addition to performing the conventional steps of AbS, the optimal FCB contribution is subtracted from the FCB target in order to determine a new target for introducing excitation in the additional windows (the second set of windows).

After introducing the excitation in the first set of windows as described herein, an additional set of windows, one in each search subframe, are introduced to accommodate other significant windows of energy in the target excitation. The pulses for the second set of windows are introduced through the procedure described below.

Step D: The determination of the second set of window boundaries for transition subframes.

Inputs

Endpoint of the previous search frame:

The target signals for introduction of additional windows in the transition subframes; and Positions of search subframes in the current frame.

Outputs

Positions of a second set of windows in the current frame.

Procedure

Three additional epochs are positioned in the current frame and windows of length 24 samples, centered at these epochs, are defined. The additional epochs satisfy the following four conditions (C1–C4):

(C1) Only one additional epoch is introduced in each search subframe.

(C2) No window defined by any of the additional epochs may extend beyond the boundaries of a search subframe.

(C3) If an epoch is in position, n, relative to the beginning of the search frame, then n must satisfy the equation: n=8*k+4 (k is an integer).

(C4) Among all possible epoch positions that satisfy the above conditions, the chosen epochs maximize the average energy of the target signal that is included in the windows defined by those epochs.

Step E: The determination of FCB vector and gain for the second window in transition subframes.

Inputs

The target for inclusion of additional windows in the current search subframe; and The impulse response of the weighted synthesis filter in the current subframe.

Outputs

The index of the FCB vector selected;

The optimal gain corresponding to the FCB vector selected; and

The synthesized speech signal.

Procedure

The fixed-codebook defined earlier for windows of length 24 is employed. The search is restricted to code-vectors whose non-zero pulses match in sign with the target signal in the corresponding position. The AbS procedure is used to determine the best code-vector and the corresponding gain. The best excitation is filtered through the synthesis filter and added to the speech synthesized from the excitation in the first set of windows, and the complete synthetic speech in the current search subframe is thus obtained.

Figure 13:
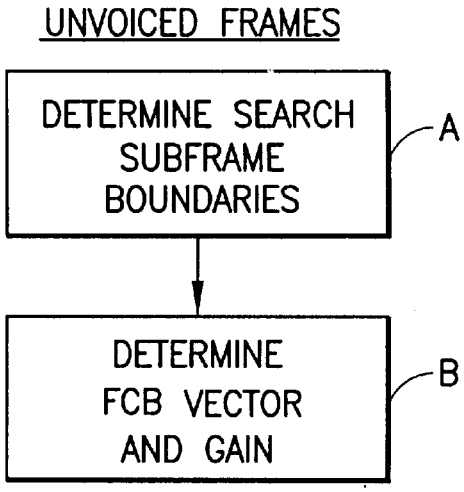

Referring now to the unvoiced encoder 42a of FIG. 9, and to the flow chart of FIG. 13, for unvoiced frames the FCB contribution in a search subframe is derived from a codebook of vectors whose components are pseudo-random ternary (−1,0 or +1) numbers. The optimal code-vector and the corresponding gain are then determined in each subframe using analysis-by-synthesis. An adaptive codebook is not used. The search subframe boundaries are determined using the procedure described below.

Step A: Determination of search subframe boundaries for unvoiced frames.

Inputs

Endpoint of previous search frame.

Outputs

Positions of search subframes in the current frame.

Procedure

The first search subframe extends from the sample following the end of the last search frame until sample number 53 (relative to the beginning of the current basic frame). The second and third search subframes are chosen to have lengths of 53 and 54 respectively. The unvoiced search frame and basic frame end in the same position.

Step B: The determination of FCB vector and gain for unvoiced subframes.

Inputs

The modified residual vector in the current search subframe;

The ZIR of the weighted synthesis filter in the current subframe; and

The impulse response of the weighted synthesis filter in the current subframe.

Outputs

The index of the FCB vector selected;

The gain corresponding to the FCB vector selected; and

The synthesized speech signal.

Procedure

The optimal FCB vector and its gain are determined via analysis-by-synthesis. The codebook, FCB_UV, of excitation vectors FCB_UV[0] . . . FCB_UV[511] is obtained from a sequence, RAN_SEQ[k] k=0 . . . 605, of ternary valued numbers in the following manner:

FCB_UV[i], {RAN_SEQ[i], RAN_SEQ[i+1], . . . , RAN_SEQ[i+L−1]}, where L is the length of the current search sub-frame. The synthesized speech signal corresponding to the optimal excitation is also computed.

Referring once more to FIG. 9, the closed loop classifier 42*d* represents the second stage of the frame-level classifier which determines the nature of the speech signal (voiced, unvoiced or transition) in a frame.

In the following equations the quantity $D_t$ is defined as the weighted squared-error of the transition hypothesis after the introduction of the first set of windows, and $D_v$ is defined as the weighted squared-error in the voiced hypothesis. The closed-loop classifier 42*d* generates an output, CLC(m) in each frame m as follows:

If $D_t<0.8\ D_v$ then CLC(m)=TRANSITION

Else if $\beta<0.7$ and $D_t<D_v$ then CLC(m)=TRANSITION

Else CLC(m)=VOICED

The closed-loop classifier 42*d* compares the relative merits of using the voiced and transition hypotheses by comparing the quantities $D_t$ and $D_v$. It should be noted that $D_t$ is not the final weighted squared-error of the transition hypothesis, but only an intermediate error measure that is obtained after a FCB contribution has been introduced in the first set of windows. This approach is preferred because the transition coder 42*b* may use a higher bit-rate than the voiced coder 42*c* and, therefore, a direct comparison of the weighted squared-errors is not appropriate. The quantities $D_t$ and $D_v$ on the other hand correspond to similar bit-rates and hence their comparison during closed-loop classification is appropriate. It is noted that the target bit rate for transition frames is 4 kb/s.

In FIG. 9 SW1–SW3 represent logical switches. The switching state of SW1 and SW2 is controlled by the state of the OLC(m) signal output from the open loop classifier 34, while the switching state of SW3 is controlled by the CLC(m) signal output from the closed loop classifier 42*d*. SW1 operates to switch the modified residual to either the input of the unvoiced encoder 42*a*, or to the input of the transition encoder 42*b* and, simultaneously, to the input of the voiced encoder 42*c*. SW2 operates to select either the synthetic speech based on the unvoiced encoder model 42*a*, or one of the synthetic speech based on the transition hypothesis output from transition encoder 42*b* or the synthetic speech based on the voiced hypothesis output from voiced encoder 42*c*, as selected by CLC(m) and SW3.

Figure 14:
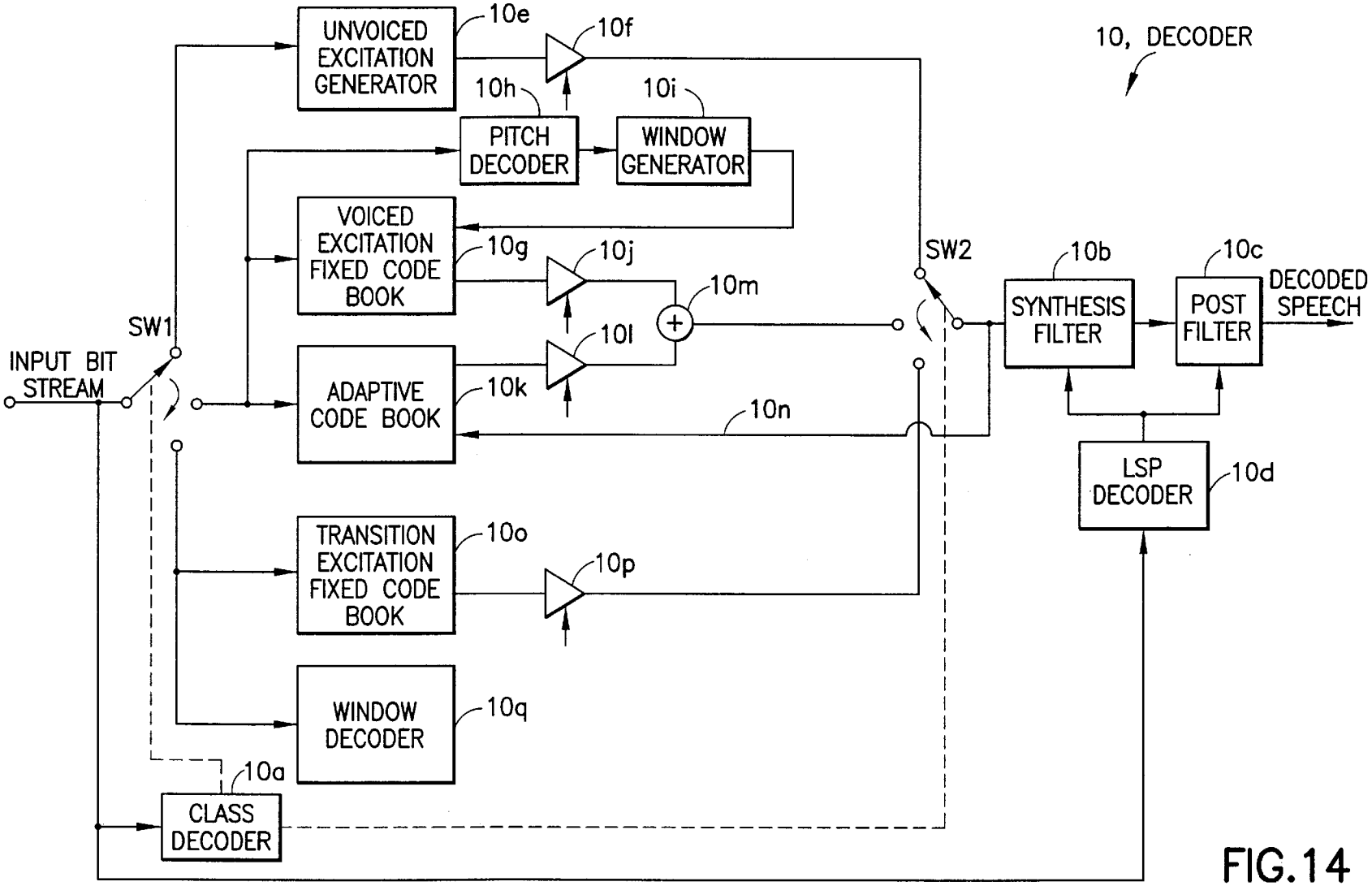
FIG. 14 is a block diagram of a speech decoder that operates in conjunction with the speech coder shown in FIGS. 8 and 9.

FIG. 14 is a block diagram of the corresponding decoder 10. Switches SW1 and SW2 represent logical switches the state of which is controlled by the classification indication (e.g., two bits) transmitted from the corresponding speech coder, as described previously. Further in this regard an input bit stream, from whatever source, is applied to a class decoder 10*a* (which controls the switching state of SW1 and SW2), and to a LSP decoder 10*d* having outputs coupled to a synthesis filter 10*b* and a postfilter 10*c*. The input of the synthesis filter 10*b* is coupled to the output of SW2, and thus represents the output of one of a plurality of excitation generators, selected as a function of the frame's class. More particularly, and in this embodiment, between SW1 and SW2 is disposed an unvoiced excitation generator 10*e* and associated gain element 10*f*. At another switch position is found the voiced excitation fixed code book 10*g* and gain element 10*j*, along with the associated pitch decoder 10*h* and window generator 10*i*, as well as an adaptive code book 10*k*, gain element 10*l*, and summing junction 10*m*. At a further switch position is found the transition excitation fixed code book 10*o* and gain element 10*p*, as well as an associated windows decoder 10*q*. An adaptive code book feedback path 10*n* exists from the output node of SW2.

Describing the decoder 10 now in further detail, the class decoder 10*a* retrieves from the input bit stream the bits carrying the class information and decodes the class therefrom. In the embodiment presented in the block diagram of FIG. 14 there are three classes: unvoiced, voiced, and transition. Other embodiments of this invention may include a different number of classes, as was made evident above.

The class decoder activates the switch SW1 which directs the input bit stream to the excitation generator corresponding to each class (each class has a separate excitation generator). For the voiced class, the bit stream contains the pitch information which is first decoded in block 10*h* and used to generate the windows in block 10*i*. Based on the pitch information, an adaptive codebook vector is retrieved from the codebook 10*g* to generate an excitation vector which is multiplied by a gain 10*j* and added to the adaptive codebook excitation by the adder 10*m* to give the total excitation for voiced frames. The gain values for the fixed and adaptive codebooks are retrieved from gain codebooks based on the information in the bit stream.

For the unvoiced class, the excitation is obtained by retrieving a random vector from the codebook 10*e* and multiplying the vector by gain element 10*f*.

For the transition class, the window positions are decoded in the window decoder 10*q*. A codebook vector is retrieved from the transition excitation fixed codebook 10*o*, using information about the window locations from windows decoder 10*q* and additional information from the bit-stream. The chosen codebook vector is multiplied by gain element 10*p*, resulting in the total excitation for transition frames.

The second switch SW2 activated by the class decoder 10*a* selects the excitation corresponding to the current class.

The excitation is applied to the LP synthesizer filter 10*b*. The excitation is also fed-back to the adaptive codebook 10*k* via the connection 10*n*. The output of the synthesizer filter is passed through the postfilter 10*c*, which is used to improve the speech quality. The synthesis filter and the postfilter parameters are based on the LPC parameters decoded from the input bit stream by the LSP decoder 10*d*.

While described above in terms of specific numbers of samples in a frame and a sub-frame, specific window sizes, specific parameter and threshold values against which comparisons are made, etc., it will be understood that presently preferred embodiments of the invention have been disclosed. Other values could be used, and the various algorithms and procedures adjusted accordingly.

Furthermore, and as was noted previously, the teachings of this invention are not limited to the use of only three or four frame classifications, and more or less than this number could be employed.

It is thus assumed that those skilled in the art may derive a number of modifications to and variations of these and other disclosed embodiments of the invention. However, all such modifications and variations are assumed to fall within the scope of the teachings of this invention, and to be embraced within scope of the claims that follow.

It is also important to note that the voice encoder of this invention is not restricted to use in a radiotelephone, or in a wireless application for that matter. For example, a voice signal encoded in accordance with the teachings of this invention could be simply recorded for later playback, and/or could be transmitted over a communications network that uses optical fiber and/or electrical conductors to convey digital signals.

Furthermore, and as was noted previously, the teachings of this invention are not limited for use with a Code Division Multiple Access (CDMA) technique or a spread spectrum technique, but could be practiced as well in, by example, a Time Division Multiple Access (TDMA) technique, or some other multiple user access technique (or in a single user access technique as well).

Thus, while it is understood that this invention has been particularly shown and described with respect to preferred embodiments thereof, it will be further understood by those skilled in the art that changes in form and details may be made therein without departing from the scope and spirit of the invention.

What is claimed is:

1. A method for coding a speech signal, comprising steps of:

partitioning samples of the speech signal into frames;

classifying the speech signal in each frame into one of a plurality of classes, wherein the step of classifying classifies a frame as being one of an unvoiced frame or a not unvoiced frame and classifies said not unvoiced frame as being one of a voiced frame or a transition frame;

determining the location of at least one window in the frame; and encoding an excitation for the frame, whereby all or substantially all of non-zero excitation amplitudes lie within the at least one window.

2. A method as in claim 1, further comprising a step of deriving a residual signal for each frame; and wherein the location of the at least one window is determined by examining the derived residual signal.

3. A method as in claim 1, further comprising steps of:

deriving a residual signal for each frame; and smoothing an energy contour of the residual signal;

wherein the location of the at least one window is determined by examining the smoothed energy contour of the residual signal.

4. A method as in claim 1, wherein the at least one window can be located so as to have an edge that coincides with at least one of a subframe boundary or a frame boundary.

5. A method for coding a speech signal, comprising the steps of:

partitioning samples of the speech signal into frames;

classifying the speech signal in each frame into one of a plurality of classes, wherein the step of classifying classifies a frame as being one of an unvoiced frame or a not unvoiced frame and classifies said not unvoiced frame as being one of a voiced frame or a transition frame;

deriving a residual signal for each frame;

determining a location of at least one window, whose center lies within the frame, by considering the residual signal for the frame; and encoding an excitation for the frame whereby all or substantially all of non-zero excitation amplitudes lie within the at least one window.

6. A method as in claim 5, wherein the step of deriving a residual signal for each frame includes a step of smoothing an energy contour of the residual signal; and wherein the location of the at least one window is determined by examining the smoothed energy contour of the residual signal.

7. A method as in claim 5, wherein a subframe or frame boundary is modified so that the window lies entirely within the modified subframe or frame and the boundary is located so as to have an edge of the modified frame or subframe coincide with a window boundary.

8. A method for coding a speech signal, comprising steps of:

partitioning samples of the speech signal into frames;

deriving a residual signal for each frame;

classifying the speech signal in each frame into one of a plurality of classes, wherein the step of classifying classifies a frame as being one of an unvoiced frame or a not unvoiced frame and classifies said not unvoiced frame as being one of a voiced frame or a transition frame;

identifying the location of at least one window in the frame by examining the residual signal for the frame;

encoding an excitation for the frame using one of a plurality of excitation coding techniques selected according to the class of the frame; and for at least one of the classes, confining all or substantially all of non-zero excitation amplitudes to lie within the windows.

9. A method as in claim 8, wherein the classes are comprised of voiced frames, unvoiced frames, and transition frames.

10. A method as in claim 8, wherein the classes are comprised of strongly periodic frames, weakly periodic frames, erratic frames, and unvoiced frames.

11. A method as in claim 8, wherein the step of classifying the speech signal comprises steps of:

forming a smoothed energy contour from the residual signal; and considering a location of peaks in the smoothed energy contour.

12. A method as in claim 8, wherein one of the plurality of codebooks is comprised of an adaptive codebook.

13. A method as in claim 8, wherein one of the plurality of codebooks is comprised of a fixed ternary pulse coding codebook.

14. A method as in claim 8, wherein the step of classifying uses an open loop classifier followed by a closed loop classifier.

15. A method as in claim 8, wherein the step of classifying uses a first classifier to classify said frame as being one of said unvoiced frame or said not unvoiced frame, and a second classifier for classifying said not unvoiced frame as being one of a voiced frame or a transition frame.

16. A method as in claim 8, wherein the step of encoding comprises steps of:

partitioning the frame into a plurality of subframes; and positioning at least one window within each subframe.

17. A method as in claim 16, wherein the step of positioning at least one window positions a first window at a location that is a function of a pitch of the frame, and positions subsequent windows as a function of the pitch of the frame and as a function of the position of the first window.

18. A method as in claim 8, wherein the step of identifying the location of at least one window includes a step of smoothing the residual signal, and wherein the step of identifying considers the presence of energy peaks in the smoothed contour of the residual signal.

19. A method for coding a speech signal, comprising steps of:

partitioning samples of the speech signal into frames;

classifying the speech signal in each frame into one of a plurality of classes, wherein the step of classifying classifies a frame as being one of an unvoiced frame or a not unvoiced frame and classifies said not unvoiced frame as being one of a voiced frame or a transition frame;

modifying the duration and boundaries of a frame or a subframe by considering the speech or residual signal for the frame; and encoding an excitation for the frame using an analysis-by-synthesis coding technique.

20. A method as in claim 19, wherein the speech signal in each frame is classified into one of a plurality of classes, and an excitation for the frame is encoded using one of a plurality of analysis-by-synthesis coding techniques selected according to the class of the frame.

21. Apparatus for coding speech, comprising:

a framing unit for partitioning samples of an input speech signal into frames;

a first classifier for classifying a frame as being one of an unvoiced frame or a not unvoiced frame and a second classifier for classifying said not unvoiced frame as being one of a voiced frame or a transition frame;

a windowing unit for determining the location of at least one window in a frame; and an encoder for encoding an excitation for the frame such that all or substantially all of non-zero excitation amplitudes lie within the at least one window.

22. Apparatus as in claim 21, further comprising a unit for deriving a residual signal for each frame; and wherein said windowing unit determines the location of the at least one window by examining the derived residual signal.

23. Apparatus as in claim 21, further comprising:

a unit for deriving a residual signal for each frame; and a unit for smoothing an energy contour of the residual signal;

wherein said windowing unit determines the location of the at least one window by examining the smoothed energy contour of the residual signal.

24. Apparatus as in claim 21, wherein said windowing unit is operative for locating said at least one window so as to have an edge that coincides with at least one of a subframe boundary or a frame boundary.

25. A wireless voice communicator, comprising;

a wireless transceiver comprising a transmitter and a receiver;

an input speech transducer and an output speech transducer; and a speech processor comprising, a sampling and framing unit having an input coupled to an output of said input speech transducer for partitioning samples of an input speech signal into frames;

a first classifier for classifying a frame as being one of an unvoiced frame or a not unvoiced frame and a second classifier for classifying said not unvoiced frame as being one or a voiced frame or a transition frame;

a windowing unit for determining the location of at least one window in a frame; and an encoder for providing an encoded speech signal where, in an excitation for the frame, all or substantially all of non-zero excitation amplitudes lie within the at least one window;

said wireless communicator further comprising a modulator for modulating a carrier with the encoded speech signal, said modulator having an output coupled to an input of said transmitter;

a demodulator having an input coupled to an output of said receiver for demodulating a carrier that is encoded with a speech signal and that was transmitted from a remote transmitter; and said speech processor further comprising a decoder having an input coupled to an output of said demodulator for decoding an excitation from a frame wherein all or substantially all of non-zero excitation amolitudes lie within at least one window, said decoder having an output coupled to an input of said output speech transducer.

26. A wireless communicator as in claim 25, wherein said speech processor further comprises a unit for deriving a residual signal for each frame; and wherein said windowing unit determines the location of the at least one window by examining the derived residual signal.

27. A wireless communicator as in claim 25, wherein said speech processor further comprises:

a unit for deriving a residual signal for each frame; and a unit for smoothing an energy contour of the residual signal;

wherein said windowing unit determines the location of the at least one window by examining the smoothed energy contour of the residual signal.

28. A wireless communicator as in claim 25, wherein said windowing unit is operative for locating said at least one window so as to have an edge that coincides with at least one of a subframe boundary or a frame boundary.

29. A wireless communicator as in claim 25, wherein said speech processor further comprises a unit for modifying the duration and boundaries of a frame or a subframe by considering the speech or residual signal for the frame; and wherein said encoder encodes an excitation for the frame using an analysis-by-synthesis coding technique.

30. A wireless communicator as in claim 25, wherein a frame is comprised of at least two subframes, and wherein said windowing unit operates such that a subframe boundary or a frame boundary is modified so that the window lies entirely within the modified subframe or frame, and the boundary is located so as to have an edge of the modified frame or subframe coincide with a window boundary.

31. A wireless communicator as in claim 25, wherein said windowing unit operates such that windows are centered at epochs, wherein epochs of voiced frames are separated by a predetermined distance plus or minus a jitter value, wherein said modulator further modulates said carrier with an indication of the jitter value, and wherein said demodulator further demodulates the received carrier to obtain the jitter value for the received frame.

32. A wireless communicator as in claim 31, wherein the predetermined distance is one pitch period, and wherein the jitter value is an integer between about −8 and about +7.

33. A wireless communicator as in claim 25, wherein said encoder and said decoder operate at a data rate of less than about 4 kb/sec.

34. A speech decoder, comprising:

a class decoder having an input coupled to an input node of said speech decoder for extracting from an input bit stream predetermined ones of bits encoding class information for an encoded speech signal frame and for decoding the class information, wherein there are a plurality of predetermined classes; said plurality of predetermined classes comprises a voiced class, an unvoiced class and a transition class; and wherein said input bit stream is also coupled to an input of a LSP decoder;

a first multi-position switch element controlled by an output of said class decoder for directing said input bit stream to an input of one of selected one of a plurality of excitation generators, an individual one of said excitation generators corresponding to one of said plurality of predetermined classes;

a second multi-position switch element controlled by said output of said class decoder for coupling an output of the selected one of said excitation generators to an input of a synthesizer filter and, via a feedback path, also to said adaptive code book;

an unvoiced class excitation generator and a transition class excitation generator coupled between said first and second multi-position switch elements;

wherein for said transition class, at least one window position is decoded in a window decoder having an input coupled to said input bit stream; and wherein a codebook vector is retrieved from a transition excitation fixed codebook using information concerning the at least one window location output from said window decoder and by multiplying a retrieved codebook vector; and wherein for said voiced class, the input bit stream encodes pitch information for the encoded speech signal frame which is decoded in a pitch decoder block having an output coupled to a window generator block that generates at least one window based on the decoded pitch information, said at least one window being used to retrieve, from an adaptive code book, an adaptive code book vector used for generating an excitation vector which is multiplied by a gain element and added to an adaptive codebook excitation to give a total excitation for a voiced frame.

35. A speech decoder as in claim 34, wherein for said unvoiced class, the excitation is obtained by retrieving a random vector from a unvoiced codebook and multiplying the vector.

36. A speech decoder as in claim 34, wherein all or substantially all of non-zero excitation amplitudes lie within the at least one window.

37. A speech decoder as in claim 34, wherein all or substantially all of non-zero excitation amplitudes lie within the at least one window decoded by said window decoder.

38. A speech decoder as in claim 34, and further comprising:

a second multi-position switch element controlled by said output of said class decoder for coupling an output of the selected one of said excitation generators to an input of a synthesizer filter and, via a feedback path, also to said adaptive code book, an output of said synthesizer filter being coupled to an input of a postfilter having an output coupled to an output node of said decoder; wherein parameters of said synthesis filter and said postfilter are based on parameters decoded from said input bit stream by said LSP decoder.

* * * * *

UNITED STATES PATENT AND TRADEMARK OFFICE

CERTIFICATE OF CORRECTION

PATENT NO. : 6,311,154 B1
DATED : October 30, 2001
INVENTOR(S) : Gersho et al.

It is certified that error appears in the above-identified patent and that said Letters Patent is hereby corrected as shown below:

Title page,
Item [73], please add -- SignalCom, Inc., 7127 Hollister Ave., Suite 105, Goleta, CA 93177 -- as an assignee.

Signed and Sealed this

Sixteenth Day of September, 2003

JAMES E. ROGAN
*Director of the United States Patent and Trademark Office*